US007677188B2

(12) United States Patent
Magni et al.

(10) Patent No.: US 7,677,188 B2
(45) Date of Patent: Mar. 16, 2010

(54) DEVICE AND METHOD FOR HANDLING TUBULAR KNITTED ARTICLES SUCH AS SOCKS OR THE LIKE TO PERFORM SEWING OF THE TOE

(75) Inventors: Antonio Magni, Florence (IT); Nerino Grassi, Mantova (IT)

(73) Assignee: Golden Lady Company S.p.A., Jesi (IT)

( * ) Notice: Subject to any disclaimer, the term of this patent is extended or adjusted under 35 U.S.C. 154(b) by 193 days.

(21) Appl. No.: 11/574,276

(22) PCT Filed: Dec. 7, 2005

(86) PCT No.: PCT/IT2005/000722

§ 371 (c)(1),
(2), (4) Date: Feb. 26, 2007

(87) PCT Pub. No.: WO2006/061870

PCT Pub. Date: Jun. 15, 2006

(65) Prior Publication Data

US 2008/0000408 A1 Jan. 3, 2008

(30) Foreign Application Priority Data

Dec. 10, 2004 (IT) ..... FI2004A0259

(51) Int. Cl.
*D05B 39/00* (2006.01)
*D05B 33/00* (2006.01)

(52) U.S. Cl. ..... 112/470.15

(58) Field of Classification Search ..... 112/470.07, 112/470.14, 470.15, 153, 475.01, 475.03, 112/311, 475.12; 66/148
See application file for complete search history.

(56) References Cited

U.S. PATENT DOCUMENTS

| | | | | |
|---|---|---|---|---|
| 4,132,183 | A * | 1/1979 | Kienel | 112/475.04 |
| 4,564,133 | A | 1/1986 | Gazzarrini | |
| 5,040,475 | A | 8/1991 | Fournier et al. | |
| 5,207,165 | A * | 5/1993 | Gazzarrini | 112/470.15 |
| 5,272,993 | A * | 12/1993 | Gazzarrini | 112/470.15 |
| 5,606,876 | A * | 3/1997 | Sangiacomo | 66/148 |
| 5,727,488 | A * | 3/1998 | Moll | 112/470.14 |
| 6,003,345 | A | 12/1999 | Jordan | |
| 6,132,166 | A * | 10/2000 | Migliorini | 414/784 |
| 6,158,367 | A | 12/2000 | Jordan et al. | |
| 6,209,363 | B1 | 4/2001 | Jordan | |

FOREIGN PATENT DOCUMENTS

| | | |
|---|---|---|
| EP | 0 521 206 A1 | 1/1993 |
| EP | 0 679 746 A2 | 11/1995 |

(Continued)

*Primary Examiner*—Ismael Izaguirre
(74) *Attorney, Agent, or Firm*—McGlew and Tuttle, P.C.

(57) ABSTRACT

The device comprises a loading member (3) onto which the tubular knitted article (M) is loaded, and a pick-up member to engage the open toe of the article. The pick-up member has a plurality of elements (13) to engage the toe of the article, arranged about the axis of the loading member, which can take a circular or polygonal configuration and a substantially rectilinear flattened configuration to pick up the article from the loading member and insert it in a guide or in a guillotine (61) of a sewing machine.

53 Claims, 37 Drawing Sheets

FOREIGN PATENT DOCUMENTS

| | | | |
|---|---|---|---|
| WO | WO 01/53581 | A1 | 7/2001 |
| WO | WO 02/070801 | A1 | 9/2002 |
| WO | WO 02/070802 | A1 | 9/2002 |
| WO | WO 03/018891 | A1 | 3/2003 |
| WO | WO 03/018903 | A1 | 3/2003 |

* cited by examiner 19
11

19A
21
71
21
23
13
19A
19
25
27
15
69
23
35
25
65
67
71
73
1
29
27
9
9
9A
7
9B
9C
3
5

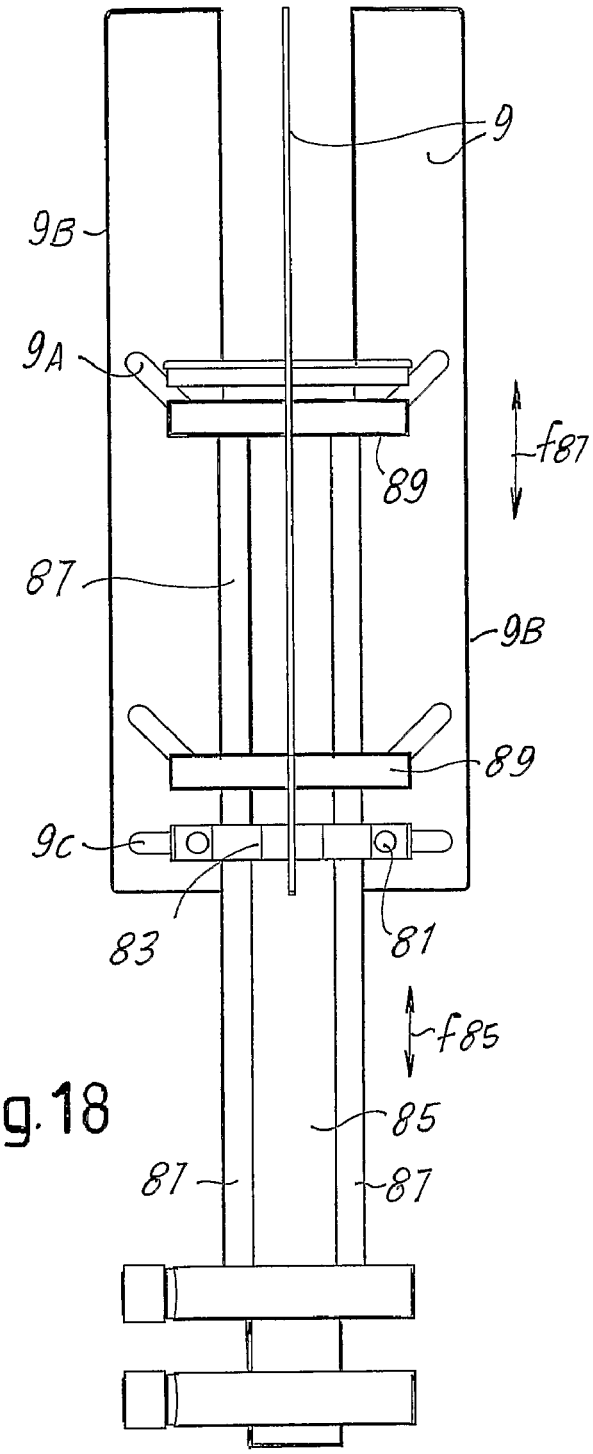
Fig.18
Fig.17
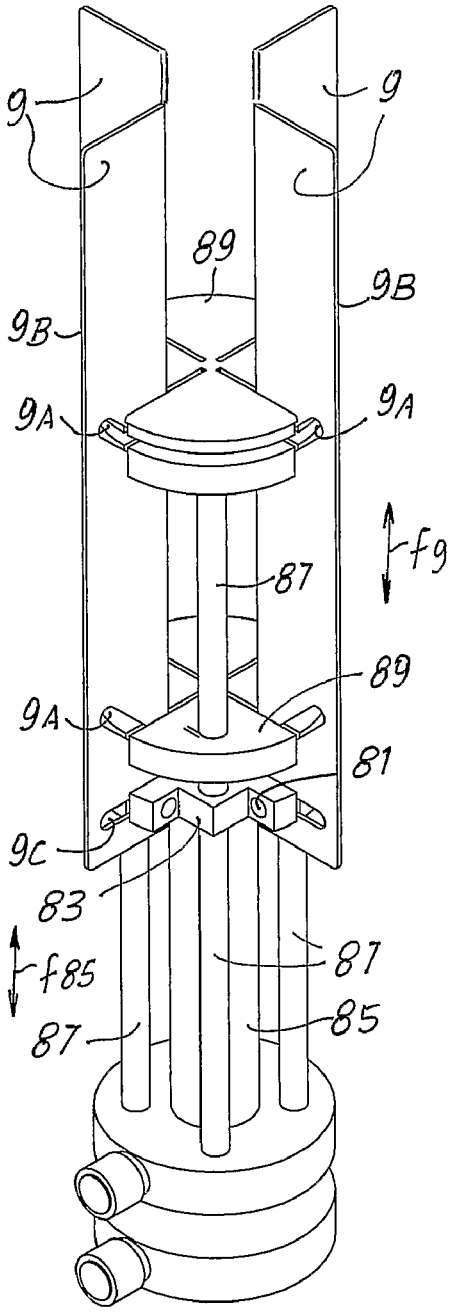

DEVICE AND METHOD FOR HANDLING TUBULAR KNITTED ARTICLES SUCH AS SOCKS OR THE LIKE TO PERFORM SEWING OF THE TOE

TECHNICAL FIELD

The present invention relates to innovations in the field of machines and devices for processing tubular knitted articles and in particular stockings and socks.

More specifically, the present invention relates to innovations in the devices which prepare these articles for sewing of the toe.

STATE OF THE ART

Socks and other tubular knitted articles are produced on circular knitting machines which provide a semi-finished article characterized by two ends: an elastic edge (at times also called cuff) and a toe which must subsequently be closed by a linking or sewing operation.

The socks are normally sewn on "toe-closing" machines, provided with a guide or "guillotine" into which the sock is inserted with its toe which has been previously oriented and arranged in a flattened configuration, i.e. with two portions or borders of the edge of the toe placed adjacent to each other and stretched transverse to the longitudinal extension of the sock. This operation is typically performed by an operator.

In order to reduce production costs various systems that automate the operation to close the toe of the sock have been studied.

In some known devices the sock is sewn directly on the knitting machine that produces it, or externally thereto by transferring each sock directly from the knitting machine to the sewing machine. Examples of machines, methods and devices to perform this type of operation are described in WO-A-02070801, WO-A-03018903; WO-A-02070802; WO-A-0153581; WO-A-03018891.

In other known devices, the socks are picked up from a basket or other container, in which they are randomly placed, and handled to take them to the correct position to be inserted in the guide of the sewing machine. An example of a device of this type is described in U.S. Pat. No. 6,158,367. Here the semi-finished article, i.e. with the toe still to be sewn, is handled to take said article onto a tube and then by engaging the toe in two diametrically opposed positions by means of a gripper which stretches the edge of the toe orthogonal to the longitudinal extension of the sock to give it a flattened configuration and subsequently insert it into the guide of the sewing machine.

EP-A-679746 describes a device that picks up the tubular article from the circular machine that produces it and transfers it to subsequent members engaging two diametrically opposed points of the edge surrounding the toe to be sewn.

EP-B-521206 and U.S. Pat. No. 5,040,475 describe a device for handling tubular articles which are picked up from a basket and sent towards a complex handling path, along which each article is oriented so that, irrespective of the direction in which it is inserted in the path, it is delivered from a magazine disposed along said path always with a pre-established orientation (i.e. with the toe or with the cuff edge facing forward) to be sent towards a tube onto which it is loaded to perform the subsequent operation to close the toe by sewing.

U.S. Pat. No. 6,209,363 and U.S. Pat. No. 6,003,345 describe methods of handling tubular articles such as socks or the like, in which two sections of fabric are produced along the edge surrounding the open toe of the article to be used in the subsequent steps to grasp and transversely stretch the edge surrounding the toe to give it a flattened form useful in the subsequent handling operations of the semi-finished article.

These methods and devices are not efficient. In some cases the devices are extremely complex, costly and not very reliable; in others the quality of the sewn product leaves much to be desired.

OBJECTS AND SUMMARY OF THE INVENTION

The object of the present invention is to provide a method and a device for handling semi-finished tubular knitted articles, such as socks and the like, to perform sewing of the toe, which entirely or partly overcomes the drawbacks of prior art devices and methods.

According to a particular aspect, the object of a preferred embodiment of the invention is to provide a device and a method, which are fast, precise and reliable in performing the operations to handle the article to obtain insertion into the guide of the sewing machine.

In substance, according to a first aspect, the invention provides a device comprising a loading member onto which the tubular knitted article is loaded, and a pick-up member to engage the open toe of the article. Advantageously, according to the invention, the pick-up member has a plurality of elements to engage the toe of the article, arranged about the axis of the loading member, which have a geometry that can vary to take a circular or polygonal configuration and a substantially rectilinear flattened configuration.

In this way the engaging elements are taken to a first configuration to grasp the edge of the tubular article and a second position in which they flatten said edge to take it from a circular or polygonal configuration to a substantially rectilinear flattened configuration, which when taken facilitates insertion of the toe of the article in the guide of the sewing machine.

In practice, the engaging elements can advantageously be divided into a first series of elements and a second series of elements. These take a polygonal or circular configuration to engage with the article and subsequently a flattened configuration, in which the elements of the first series or group are placed opposite and moved towards the elements of the second series or group, holding the edge of the toe to be sewn between them. This edge is thus divided into two borders or sections placed adjacent and stretched according to a substantially straight line orthogonal to the longitudinal extension of the sock. Typically and preferably, the engaging elements are four, divided into two series of two elements each. This simplifies the structure of the device, simultaneously making it more reliable.

According to an advantageous embodiment, the engaging elements are configured so that the distance between the ends of the toe in the flattened and substantially rectilinear configuration is greater than the diameter of the circumference according to which the engaging elements are arranged, or of the circumference inside which is inscribed the polygon according to which the elements to engage the toe are arranged when they take the initial position to prepare to pick up the article.

In an advantageous embodiment, the pick-up member includes at least one actuator and preferably two actuators, to take the engaging elements alternately to a flattened configuration and to an annular or polygonal configuration surrounding the axis of the loading member.

The loading member can include a tubular member, associated with which are stretching means to make the toe of the article, that is, the edge surrounding this toe, take a polygonal configuration. Tabs or other means, which are radially extractable from the tubular member, such as bars or rods, can be provided for this purpose. Preferably, four tabs are provided arranged so that the knitted article takes a quadrangular and preferably square configuration. For this purpose the tabs are arranged along the four diagonals of a square, the sides of which define the conformation taken by the edge surrounding the toe of the knitted article once it has been stretched and removed from the outer surface of the tubular member. The four rectilinear sections of the edge of the article, which extend between the vertices of the square defined by the four tabs are engaged by the engaging members which can be four in number and have a substantially rectilinear form.

The tabs or other equivalent extractable members can have the function of extracting the article from the tubular member through a movement parallel to the axis of said member to transfer the tubular article towards the head of the device in which the engaging elements are located.

However, it would also be possible to configure the loading member so that it makes the article directly take the polygonal configuration. In this case the loading member includes, or itself forms, the stretching means. For example, the loading member could be composed of a series of bars arranged at the vertices of a polygon, typically a quandrangle, preferably a rectangle. Alternatively, four tabs can be provided, arranged at 90° from one another in a reciprocal fixed position. The article can be loaded on these four bars or on these tabs, or on other stretching means, by means of a plurality of grippers or suction mouths. For example, four grippers or suction mouths, which can engage and extend the toe of the article to load it on the bars or tabs, can be provided. Alternatively, the article can be loaded manually. Irrespective of the conformation of the loading member and of the way in which the article is loaded onto said member, the article is deformed and stretched at the toe so that the edge of the toe takes a polygonal configuration. A number of engaging elements equivalent to the number of sides of the polygon, and substantially flat in form, is therefore adequate to engage the article for the subsequent handling operations.

Moreover, means to remove the toe of the article from the loading member can advantageously be provided, the engaging elements being axially staggered with respect to the tubular member and the toe of the article being transferred to said engaging elements by means of said removing means, although it would also be possible for the engaging elements of the tubular article to be positioned adjacent to the loading member.

In a possible embodiment, the engaging elements can be supported by a flexible member, such as a chain. A plurality of engaging elements to engage the article will be distributed along the links of the chain or of two sections of the chain. These links can take an approximately circular configuration, in which the engaging elements to engage the tubular article are arranged with a distribution that substantially follows the extension of the edge of the tubular knitted article positioned on the loading member, which in this case is preferably a tubular member. Once the engaging elements have engaged the tubular article, they can remove it from the loading member and the chains or preferably the two sections of chain (or other flexible means) which support the engaging elements can take a flattened, or spread out, configuration, to align the two edge borders of the toe of the article with each other.

Nonetheless, according to a preferred embodiment of the invention, the elements to engage the article are provided in limited number, such as four, and engage the edge of the toe after it has taken a polygonal, rather than circular, configuration. As observed, for this purpose the loading member can advantageously be shaped to make the article take a polygonal configuration, or a tubular loading member can be provided, with which means are associated to take the toe of the article to a polygonal configuration, moving it away from the outer surface of the tubular member. Each of the elements which engages the toe of the tubular article can have means to engage the fabric forming the article, such as a plurality of needles designed and arranged to engage respective portions of the edge of the toe of the article.

According to a further aspect, the invention relates to a method for handling tubular knitted articles, with an open toe to be sewn, such as socks or the like, comprising the steps of:

arranging the article with the toe in an open configuration;

engaging a first portion of the edge of the toe in a plurality of positions and a second portion of the edge of the toe in a further plurality of positions;

placing the first portion of the edge and the second portion of the edge adjacent to each other to give the toe a substantially rectilinear flattened configuration;

inserting the toe in this configuration into a guide or guillotine which can be directly the guide of the sewing machine or the guide or guillotine of a further transfer means which then performs transfer to the guide of the sewing machine.

According to one embodiment, the open toe is arranged in a polygonal configuration, and each side of said polygon is engaged by a respective engaging element, the sides of the polygon being aligned to make the toe take said substantially rectilinear flattened configuration.

For this purpose, the toe of the article can advantageously be inserted over a tubular member, for example with a circular, but optionally also elliptical, section, and subsequently stretched to move it away from the outer surface of the tubular member taking said polygonal configuration, typically and preferably a quadrangular form and in particular, although not necessarily, square.

According to a particular embodiment of the method according to the invention, the toe is then removed from the tubular member remaining in the polygonal configuration, and subsequently the sides of the polygon defined by the edge of the toe of the article are engaged by respective engaging elements and then aligned to take the aforesaid substantially rectilinear flattened configuration.

According to another aspect, the invention relates to a method for handling tubular knitted articles, with an open toe to be sewn, such as socks or the like, characterized by the steps of:

arranging the article with the toe in a substantially polygonal configuration, in which consecutive portions of the edge of the toe are arranged approximately according to the sides of a polygon, engaging each portion of the edge of the toe by means of a respective engaging element;

if required, aligning the sides of the polygon to make the toe take a substantially rectilinear flattened configuration.

According to yet another aspect, the invention relates to a device for handling tubular knitted articles such as socks or the like with an open toe, comprising stretching means to make the edge of the toe take a polygonal configuration, with consecutive portions of the edge of the toe being arranged according to the sides of a polygon. Advantageously, the device can also have a plurality of engaging elements, which engage each of said portions of the edge of the toe of the article. The engaging elements can advantageously be suitable to take a flat or flattened configuration, to spread out the toe of the article.

BRIEF DESCRIPTION OF THE DRAWINGS

The invention will be better understood by following the description and accompanying drawings, which show a non-limiting practical embodiment of the invention. More specifically, in the drawings:

FIGS. 17 and 18 show in an axonometric and side view the members to control the tabs in the extracted position;

DETAILED DESCRIPTION OF THE PREFERRED EMBODIMENTS OF THE INVENTION

Figure 1:
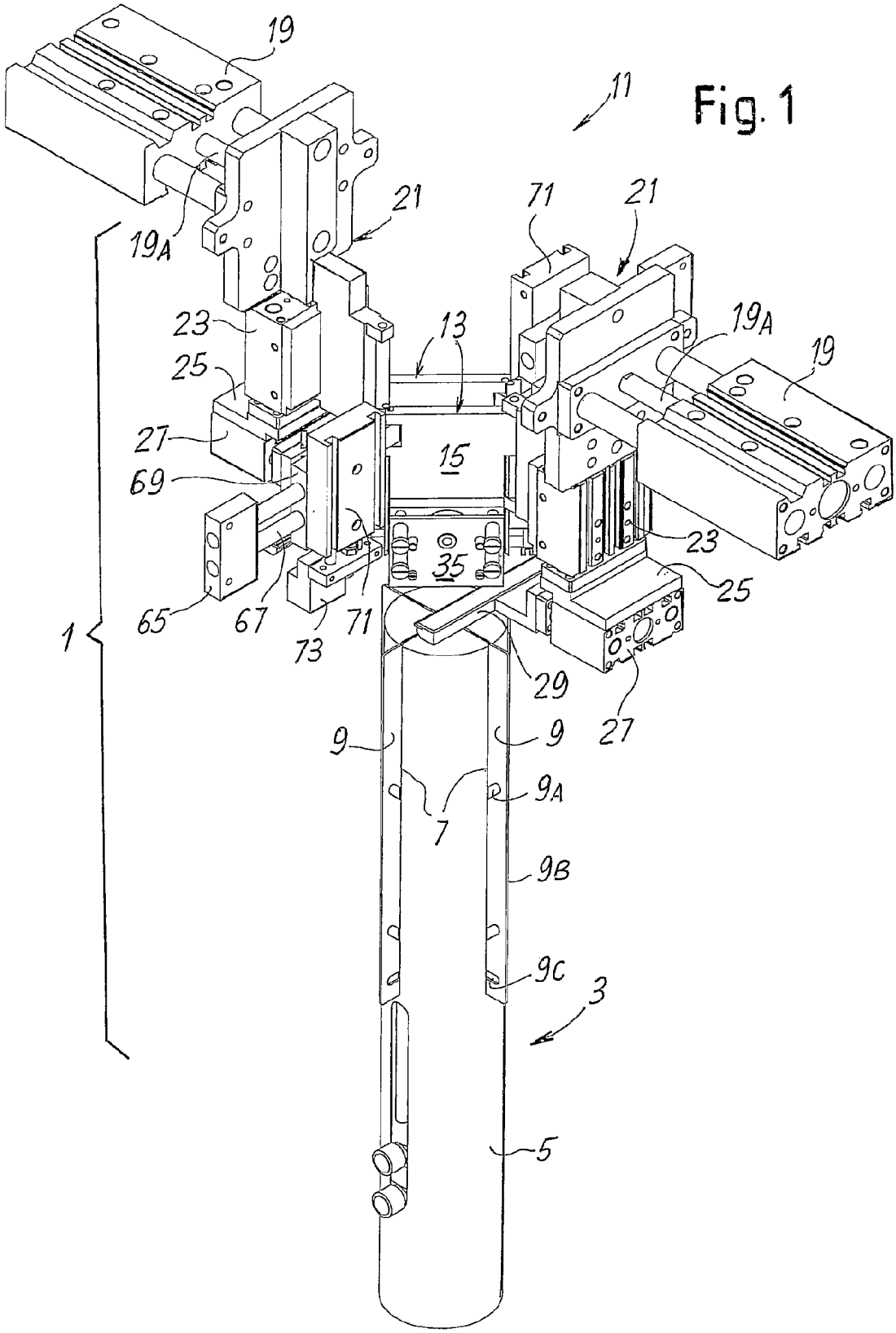
FIG. 1 shows an axonometric view of the device as a whole.
Figure 1A:
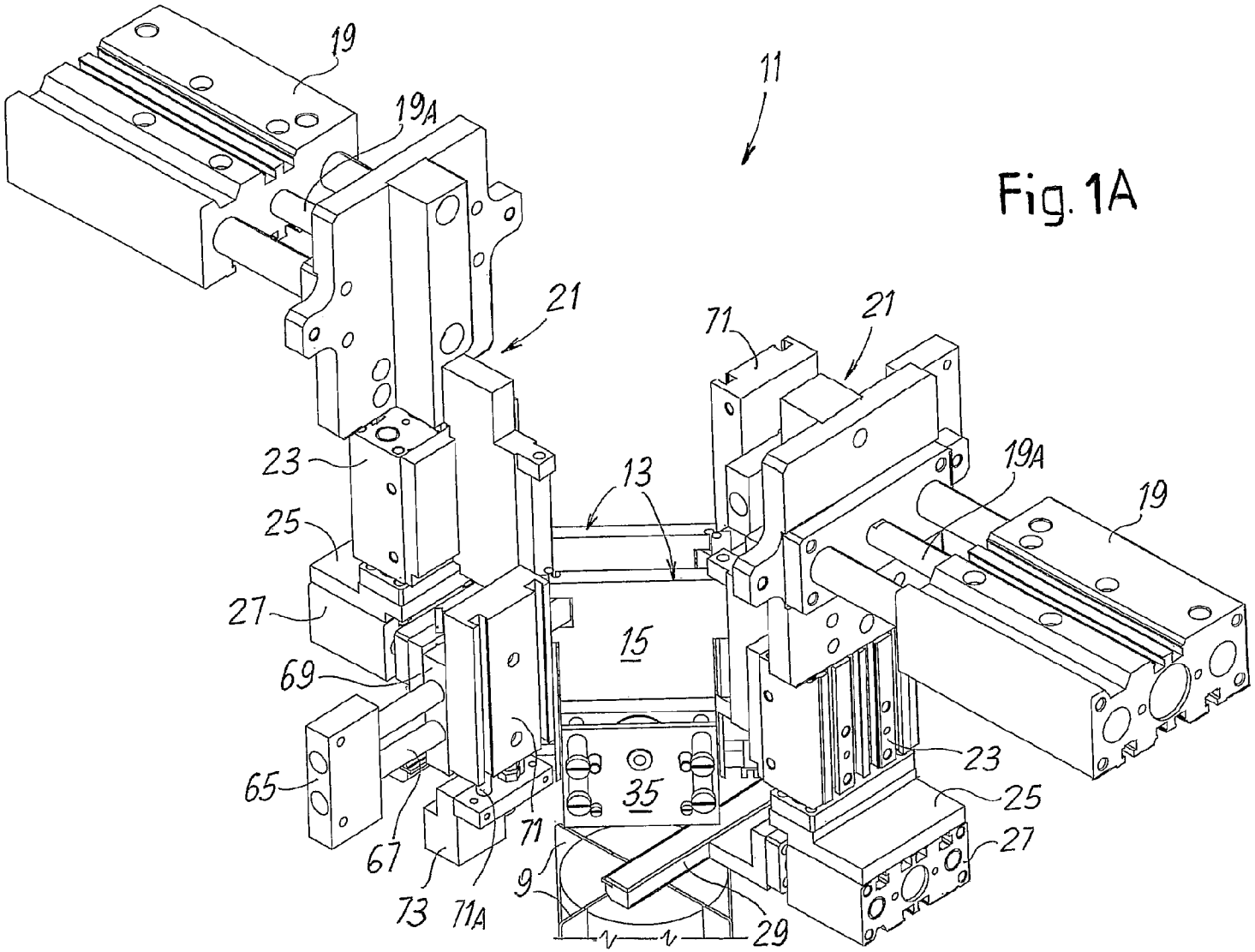
FIG. 1A shows an enlargement of the head of the device in the position in FIG. 1.

In the appended drawings, FIGS. 1 to 19 show only the mechanical parts and relative movement of the device, while the subsequent FIGS. 20 to 28 show, in schematic and simplified views, the device or part thereof with the article being processed.

In the example shown in the drawings, a loading member is provided, composed of a tubular member inside which stretching means, in this case designed as extractable tabs, are arranged. The article can be loaded onto the loading member in a conventional and known way, not described herein. However, it must be borne in mind that the loading member can also take a different configuration, for example it can be formed only of tabs or other suitable stretching means.

With particular reference to FIGS. 1 to 9, the device, indicated as a whole with 1, includes a tubular member indicated as a whole with 3 and supported by a suitable structure, not shown. The tubular member 3 can be an element to transfer the tubular knitted article through a plurality of stations of a more complex machine, of which the device 1 forms an integral part.

The tubular member 3 has a cylindrical outer wall 5 with four slits 7 parallel to the axial extension of said tubular member and terminating at the upper edge of the tubular member 3. Housed inside the cylindrical wall 5 are four tabs 9 provided with a radial extraction movement through the slits 7 and with axial lifting, that is, with a movement parallel to the axis A of the tubular member 3.

The tubular member 3 is arranged vertically in the example shown, but could also be arranged horizontally or with any other inclination, as a function of the configuration of the remaining parts of the machine.

Figure 2:
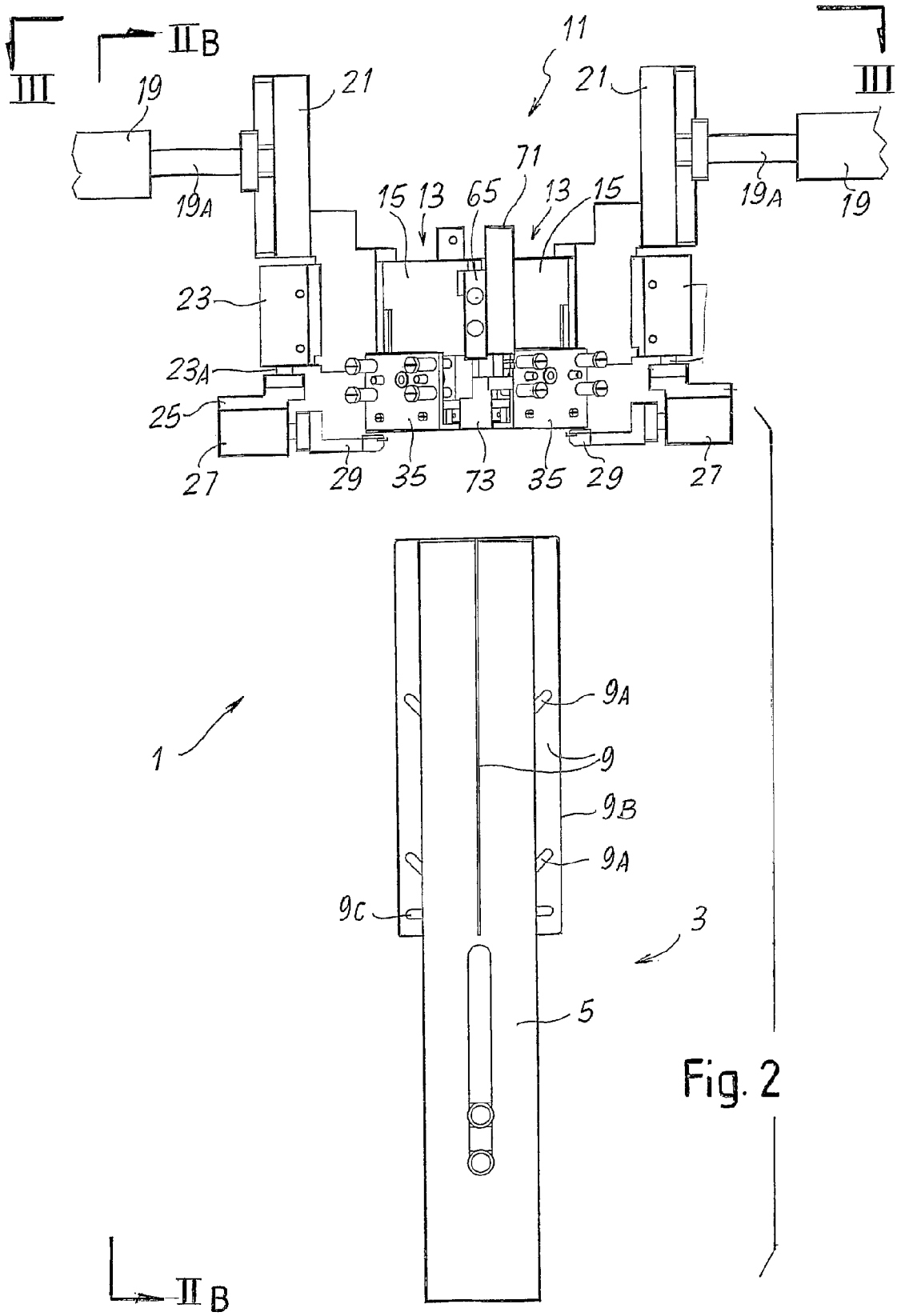
FIG. 2 shows a side view of the device in FIG. 1.
Figure 2A:
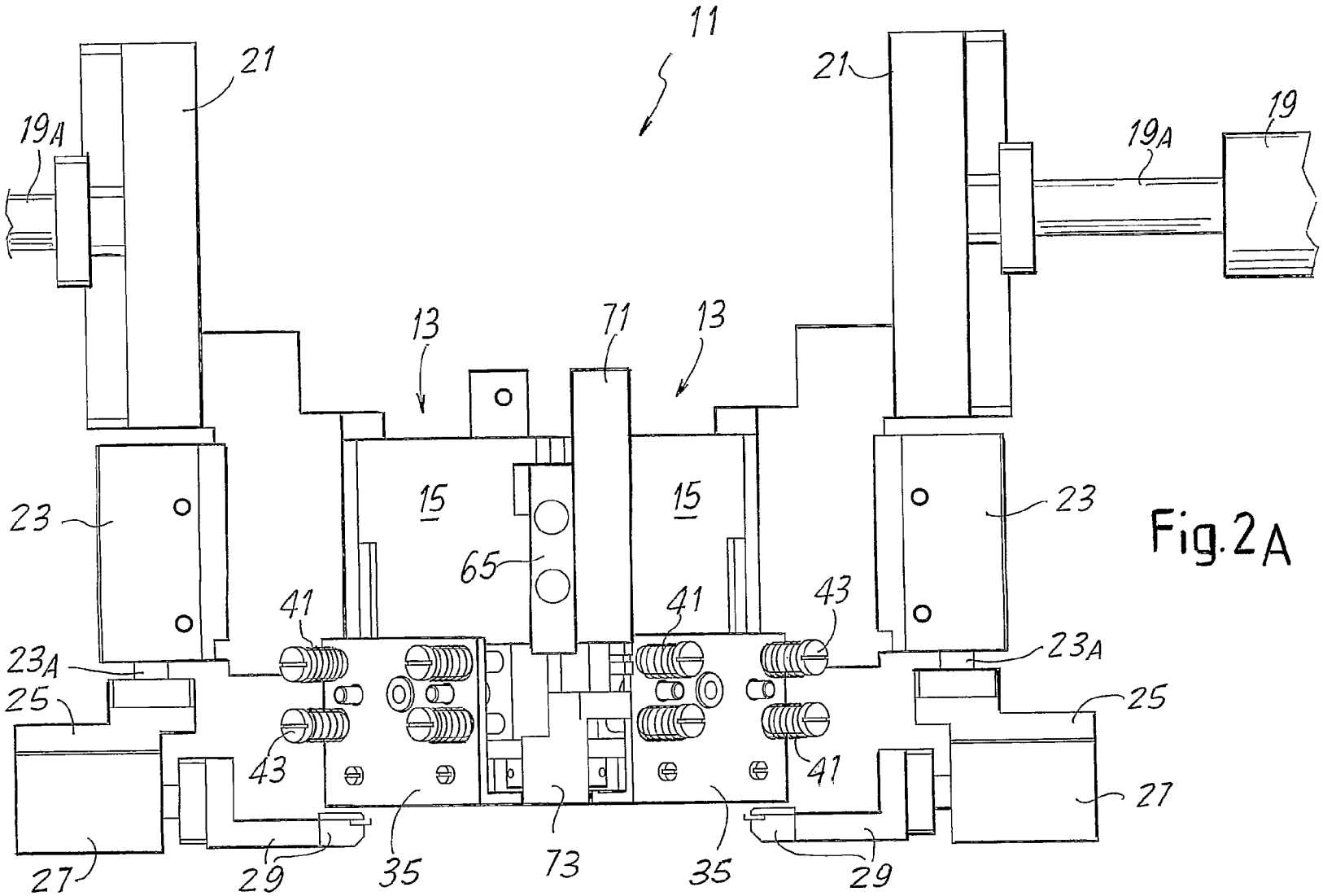
FIG. 2A shows an enlargement of the head of the device in the position in FIG. 2.
Figure 2B:
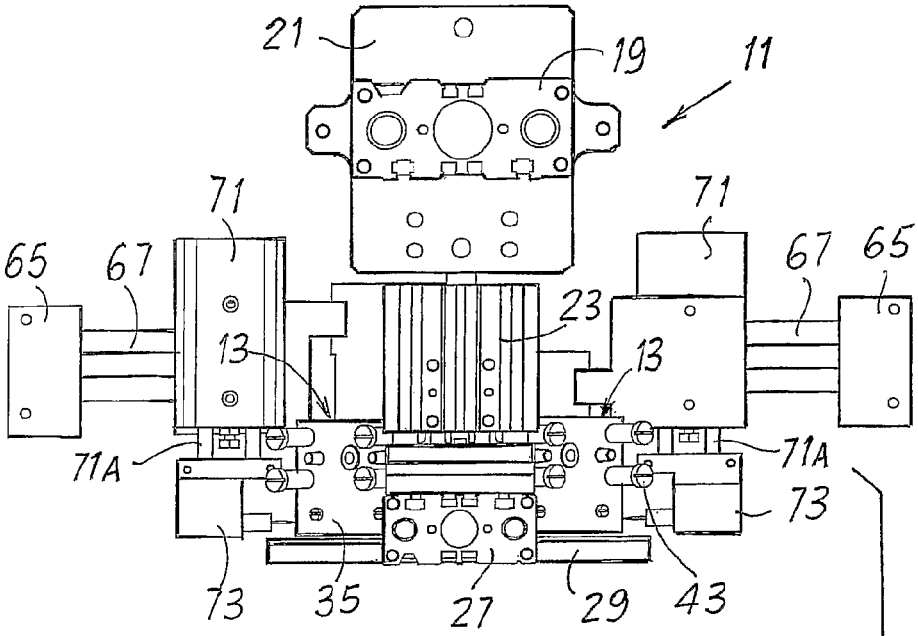
FIG. 2B shows a view according to IIB-IIB in FIG. 2.
Figure 2B:
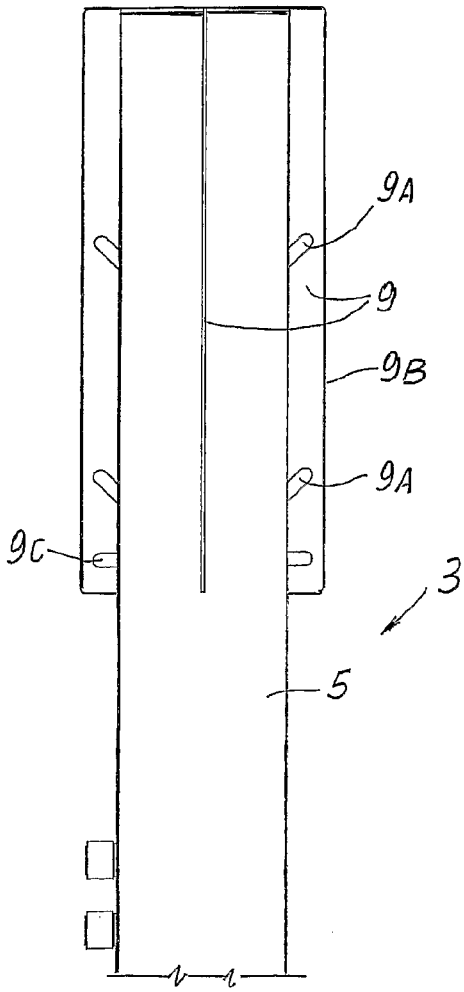
Figure 2C:
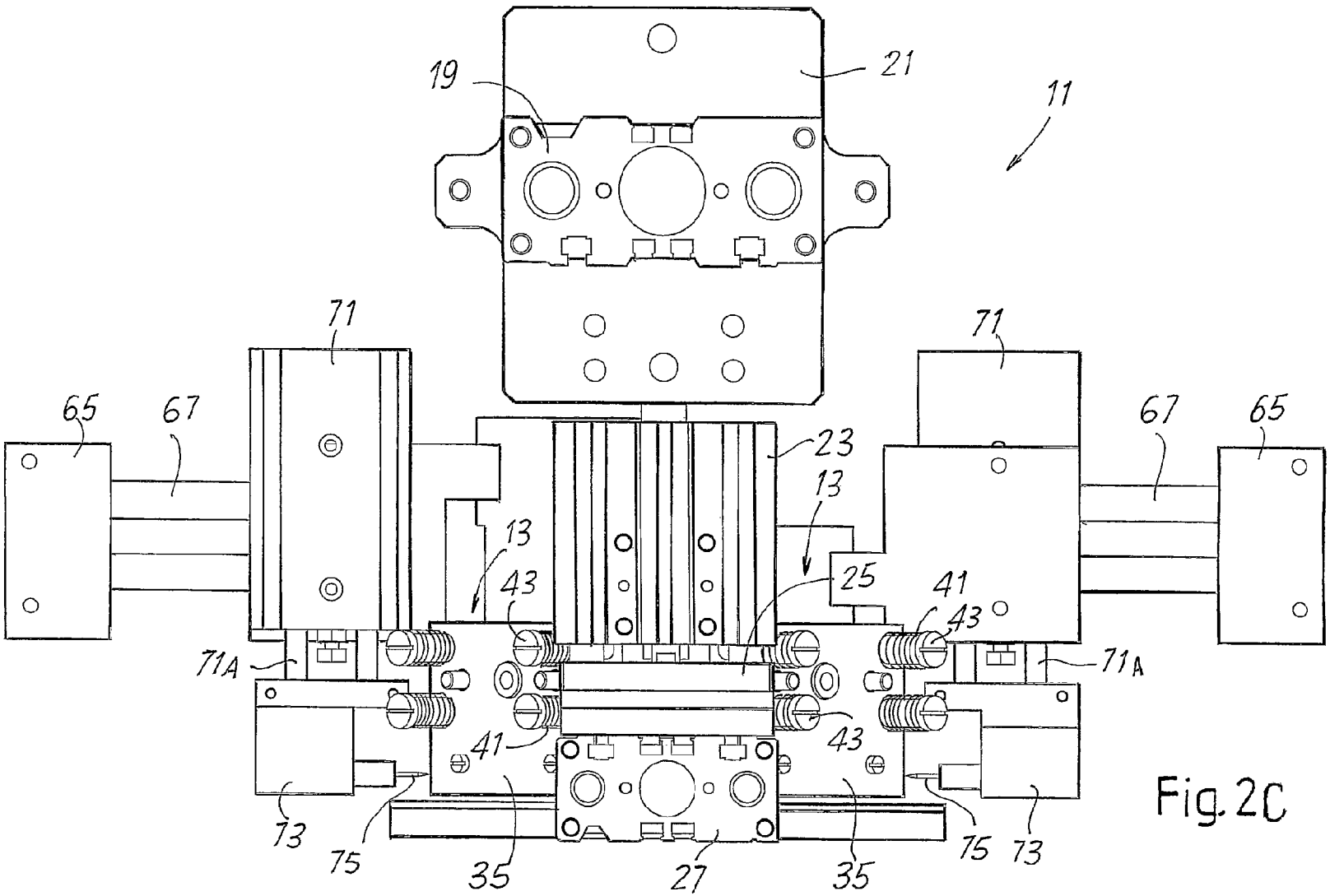
FIG. 2C shows an enlargement of the head of the device in the position in FIG. 2B.
Figure 4:
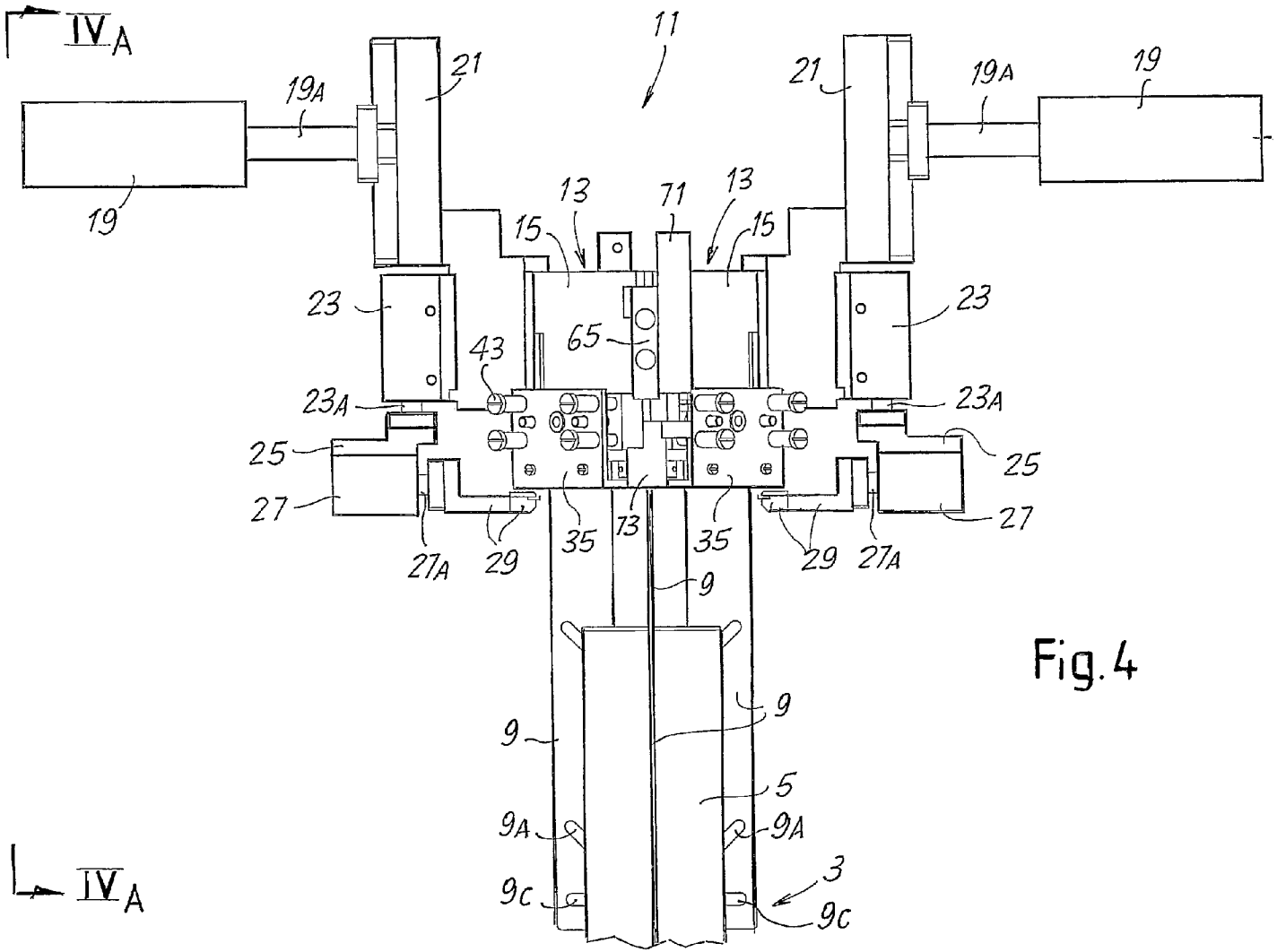
FIG. 4 shows a side view according to IV-IV in FIG. 3 but limited to the upper part of the tubular member.
Figure 4A:
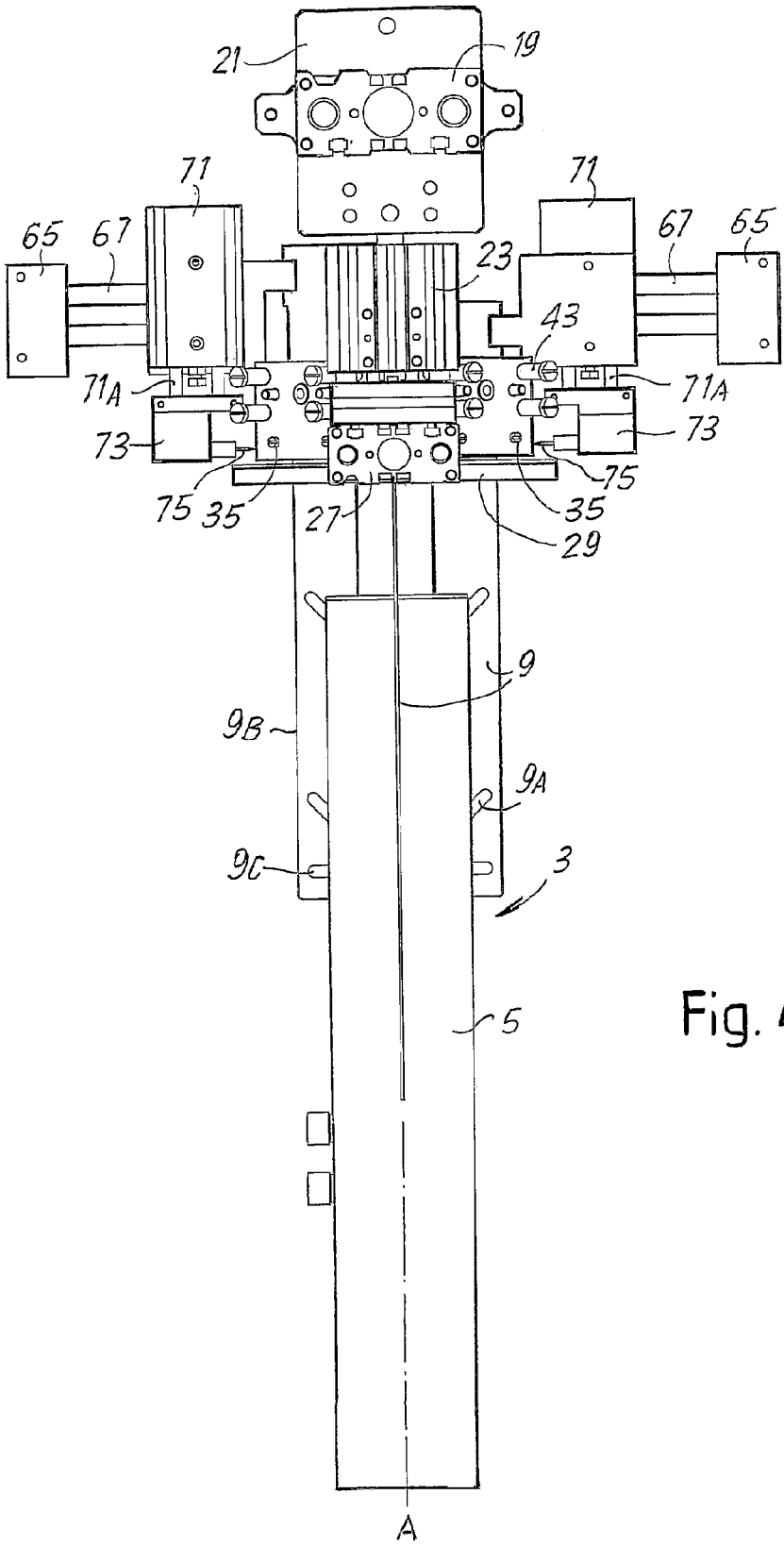
FIG. 4A shows a view according to IVA-IVA in FIGS. 3 and 4.
Figure 5:
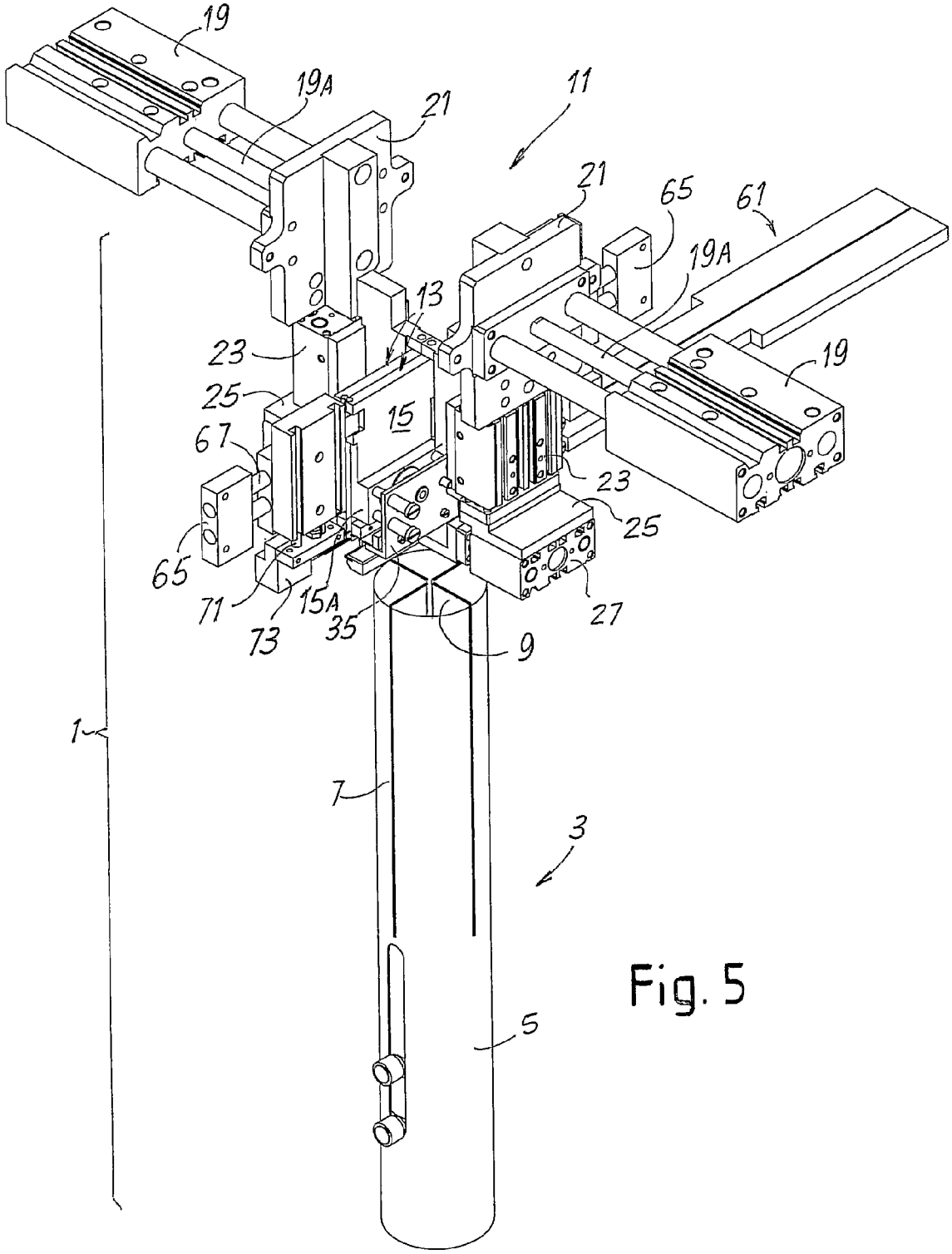
FIG. 5 shows an axonometric view analogous to the one in FIG. 1 in a different configuration of the elements to engage the article.
Figure 5A:
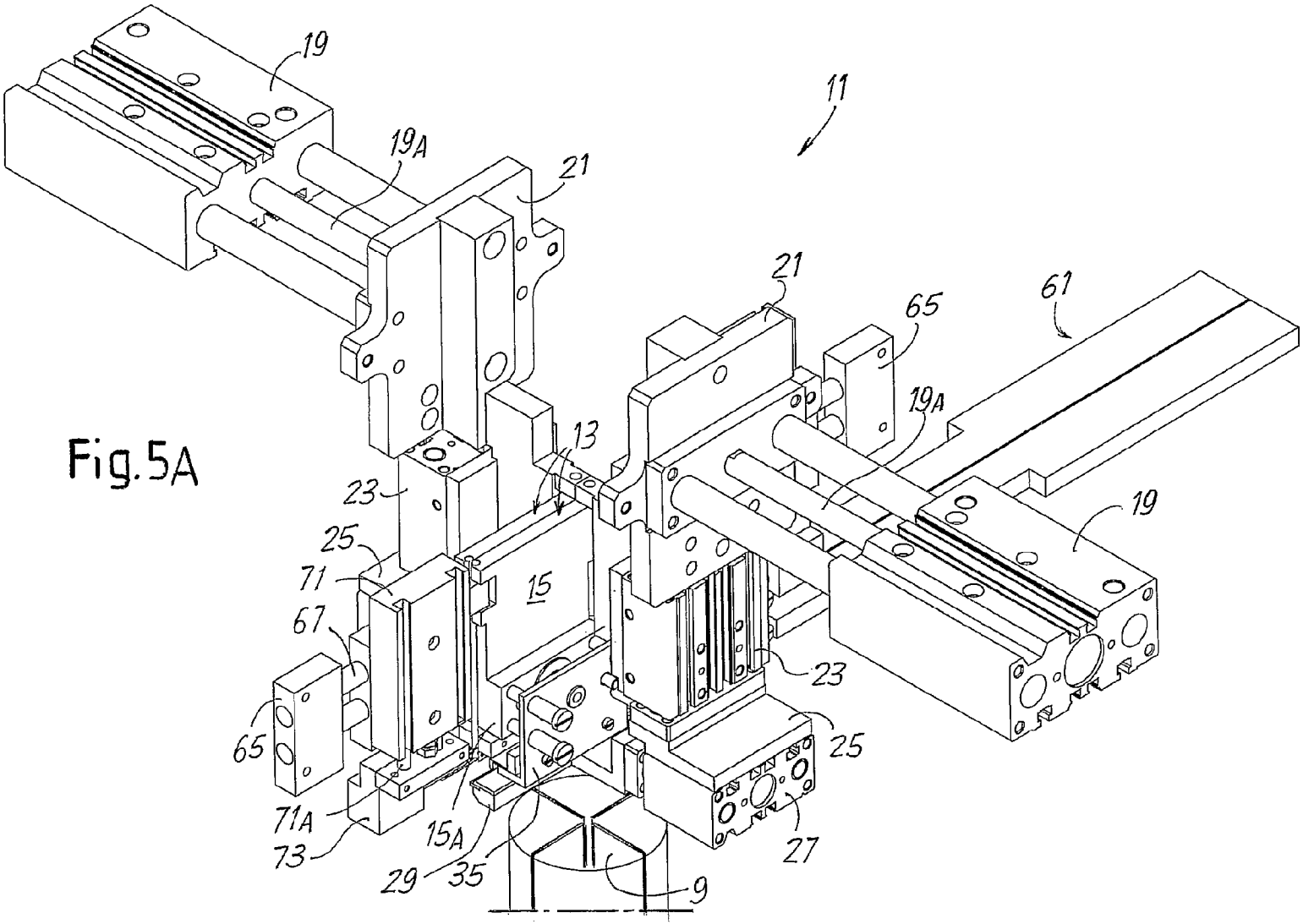
FIG. 5A shows an enlargement of the head of the device in the configuration in FIG. 5.

In FIG. 5 the tabs 9 are retracted inside the cylindrical wall of the tubular member 3, while in FIGS. 1 and 2 they are shown radially extracted and in FIG. 4 they are shown both radially extracted and moved vertically to project above the upper end of the tubular member 3. The mechanism which performs the movement of radial and axial extraction of the tabs 9 will be described in greater detail hereunder with specific reference to FIGS. 15 to 18.

Arranged above the tubular member 3 is a head, indicated as a whole with 11 and comprising a pick-up member to engage—along the edge thereof—the open toe of the article to be sewn, which reaches the head 11 loaded on the tubular member 3, as will be described in greater detail with reference to the operating cycle shown schematically in the subsequent FIGS. 20 to 28.

The head 11 includes four engaging elements to engage the toe of the article, each of which is indicated with 13 and has a plate 15, associated with which is a row of needles 17 with respective control members which will be described hereunder. The needles 17 engage (as will be described in greater detail with reference to FIGS. 19 to 28) a row of stitches along the edge of the toe to be sewn of the textile article.

Figure 3:
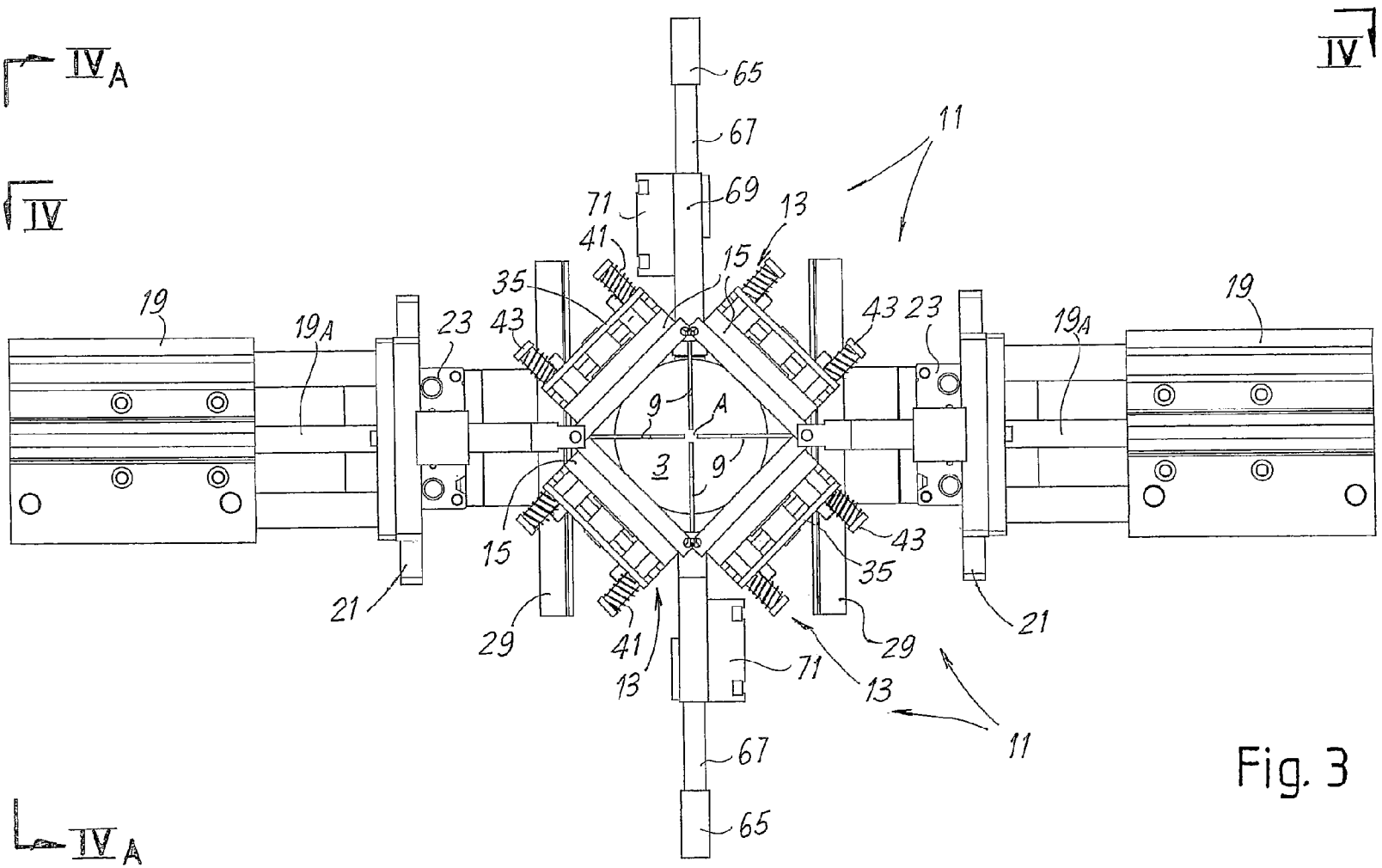
FIG. 3 shows a plan view according to III-III in FIG. 2.

As can be seen in particular in the plan view in FIG. 3, the engaging elements 13 are hinged to one another along hinge axes parallel to the axis A of the tubular member 3. The engaging elements 13 can take an open configuration, in which they are arranged along the sides of a square. In this way the plates 15 define a sort of parallelepiped with a square base. This configuration is shown in particular in FIGS. 1 to 4. The center of the square lies on the geometrical axis A of the tubular member 3.

By moving two opposed vertices of the square formed by the engaging elements 13 towards each other the configuration is modified from the aforesaid square position to a flattened or spread out position, in which the engaging elements 13 are aligned with one another in twos, and the two pairs of aligned engaging elements 13 are opposite each other. This flattened configuration is shown in particular in FIGS. 5 to 8.

The movement of the engaging elements 13 to pass from one to the other of the two configurations described is controlled by a pair of piston-cylinder actuators 19, supported by a fixed structure (not shown) and the piston rods 19A of which are connected to respective supports 21, hinged on each of which are two of the four engaging elements 13. With this arrangement the extending and retracting movement of the actuators 19 causes the opposed hinge axes of the engaging elements 13 to move towards and away from each other respectively, consequently passing from the open configuration (FIGS. 1 to 4) to the closed and flattened configuration (FIGS. 5 to 8).

Each of the supports 21 also supports a respective piston-cylinder actuator 23, connected to the piston rod 23A of which is a bracket 25, in turn supporting a further piston-cylinder actuator 27. The piston rod 27A of each of the piston-cylinder actuators 27 is connected to a respective rectilinear bar 29 extending in a direction oriented at 90° with respect to the direction of the axis A of the tubular member 3. As shall be clear hereunder, the two bars 29, cooperating with each other thanks to the movement imparted by the actuators 23 and 27, perform the function of stretching the tubular article in the direction of the longitudinal extension thereof, parallel to the axis A of the tubular member 3, to facilitate insertion into the guide of a sewing machine.

Each of the engaging elements 13 has a configuration that will now be described with specific reference to FIGS. 9 to 14. The engaging elements 13 are substantially the same as one another, except for the different dimensions of the plates 15. Therefore, only one of these elements will be described hereunder.

Figure 10:
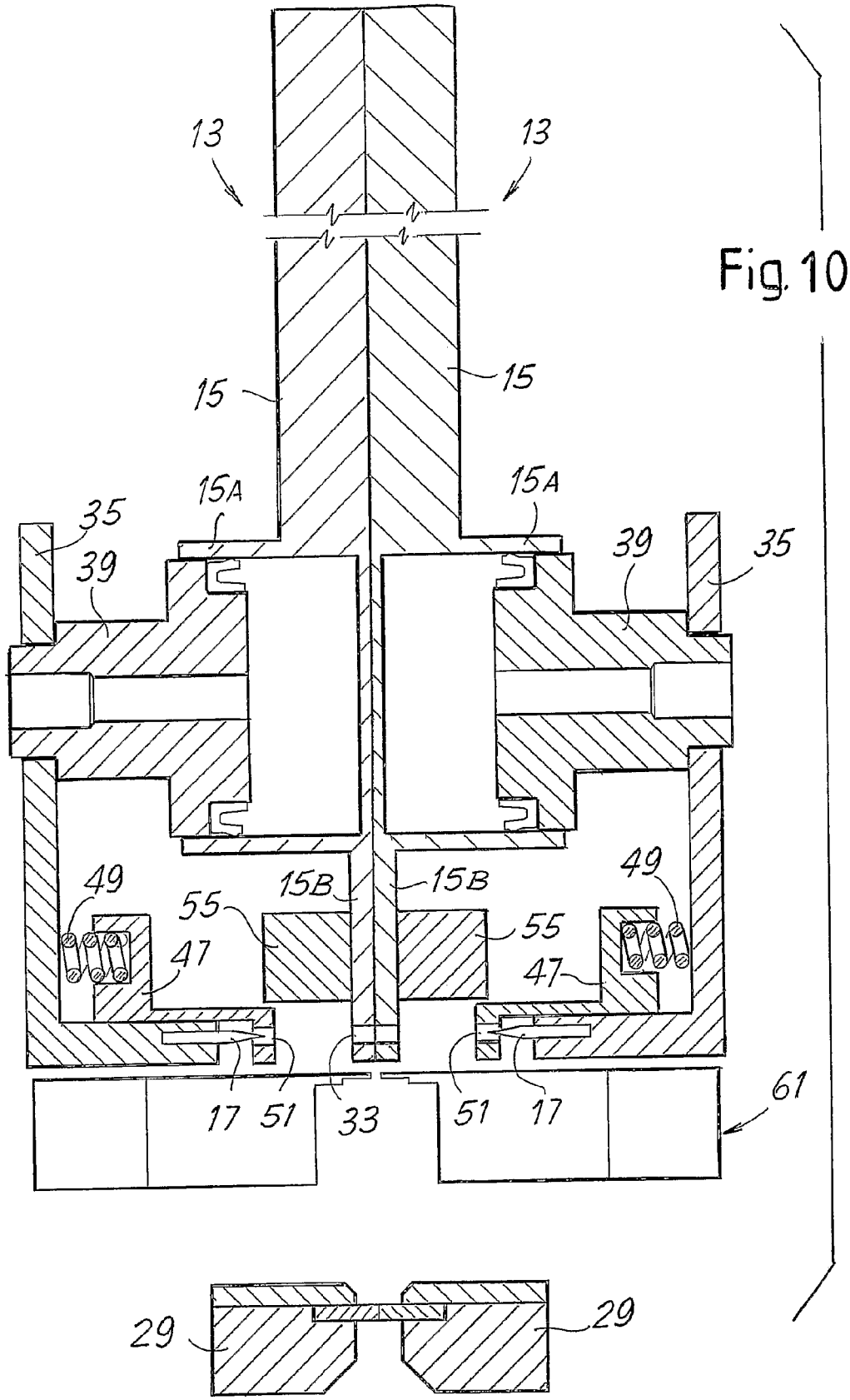

Each plate 15 forming the main body of the respective engaging element has a thicker central portion 15A, which houses a series of members described hereunder, and a thinner lower portion 15B. At the lower end of the portion 15B of the plate 15, along the horizontal edge thereof, a plurality of holes 33 are provided aligned with the edge of said plate. Needles 17 provided in number and position corresponding to the number and position of the holes 33 can be inserted in said holes 33. The needles 17 associated with each plate 15 are supported by a bracket 35, movable in a direction orthogonal to the extension of the corresponding plate 15. The movement is guided by guides 37, integral with the plate 15, and is controlled by a piston-cylinder actuator 39 housed in the thicker portion 15A of the plate 15. In FIG. 10 the piston-cylinder actuator 39 is shown in its extended position, in which the brackets 35 supporting the needles 17 are distanced with respect to the plates 15 supporting them and the needles 17 are consequently withdrawn from the holes 33. When the piston-cylinder actuator 39 is retracted, the respective bracket 35 is taken to the closed configuration with the needles 17 inserted in the holes 33 by means of compression springs 41 inserted over columns 43 screwed in blind threaded holes 45 provided in the portion with greater thickness 15A of the respective plate 15 (see in particular FIG. 11).

Figure 9:
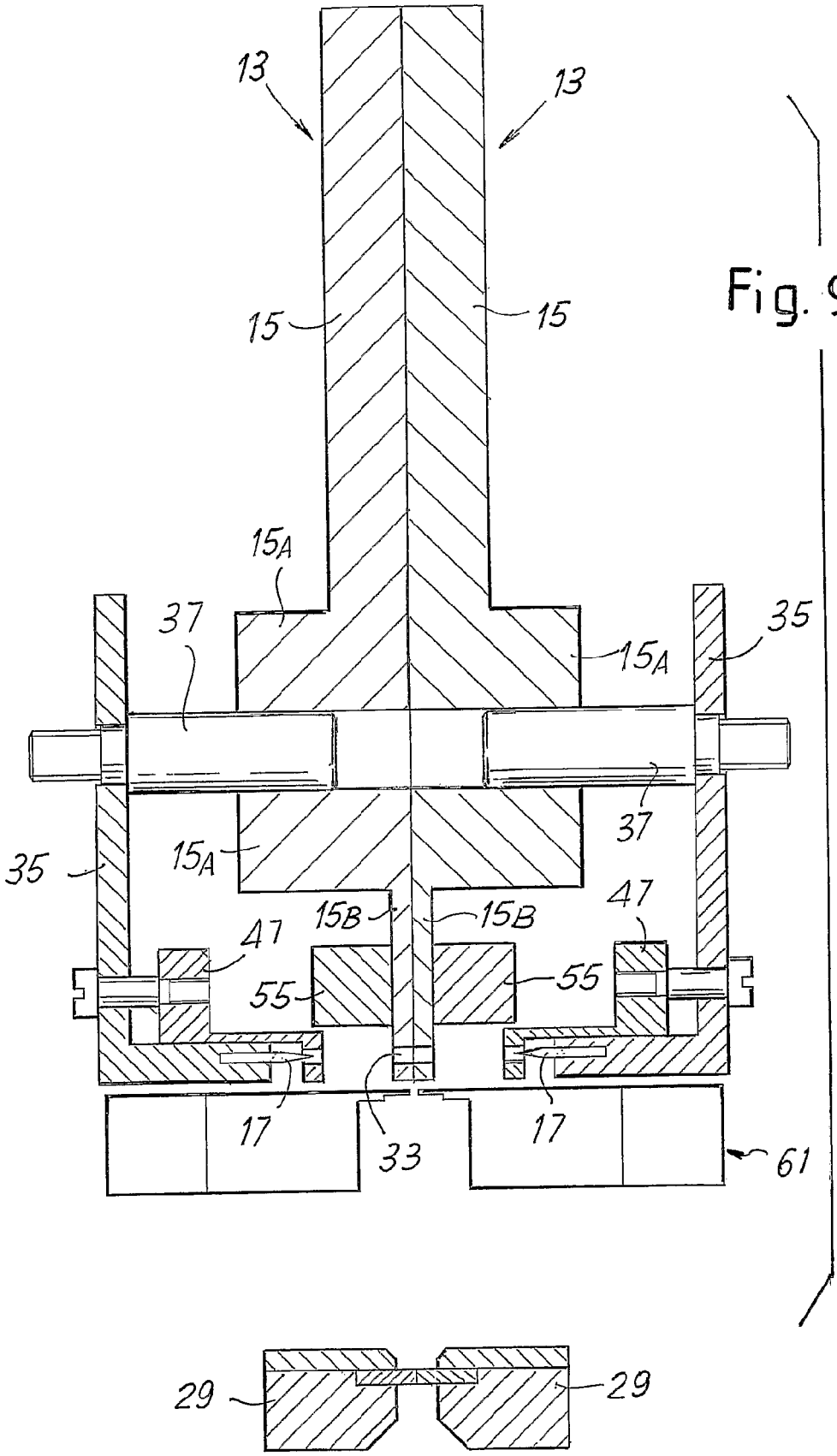
FIGS. 9, 10 and 11 show cross sections of the elements to engage the article according to different section planes.
Figure 11:
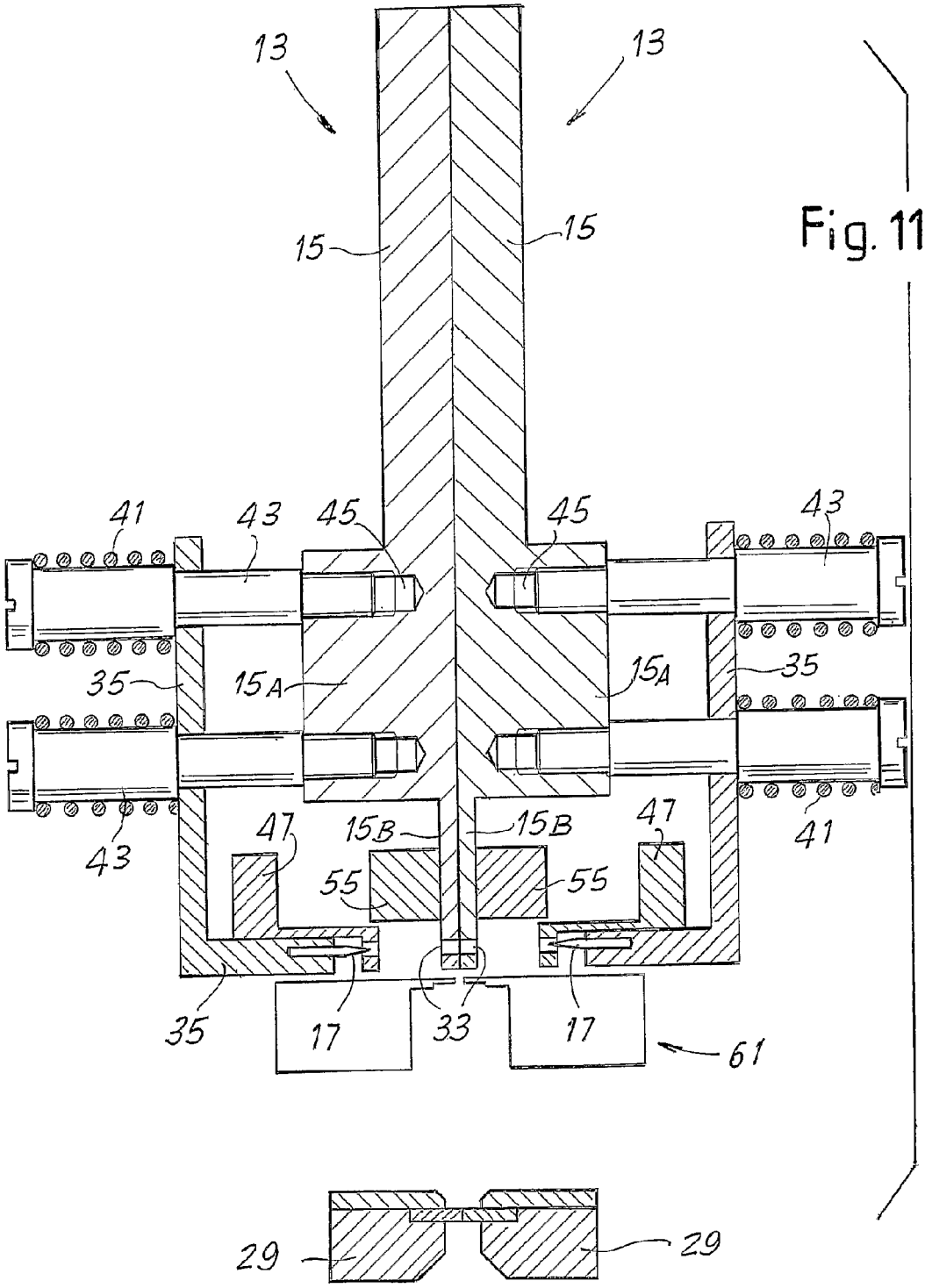
Figure 12:
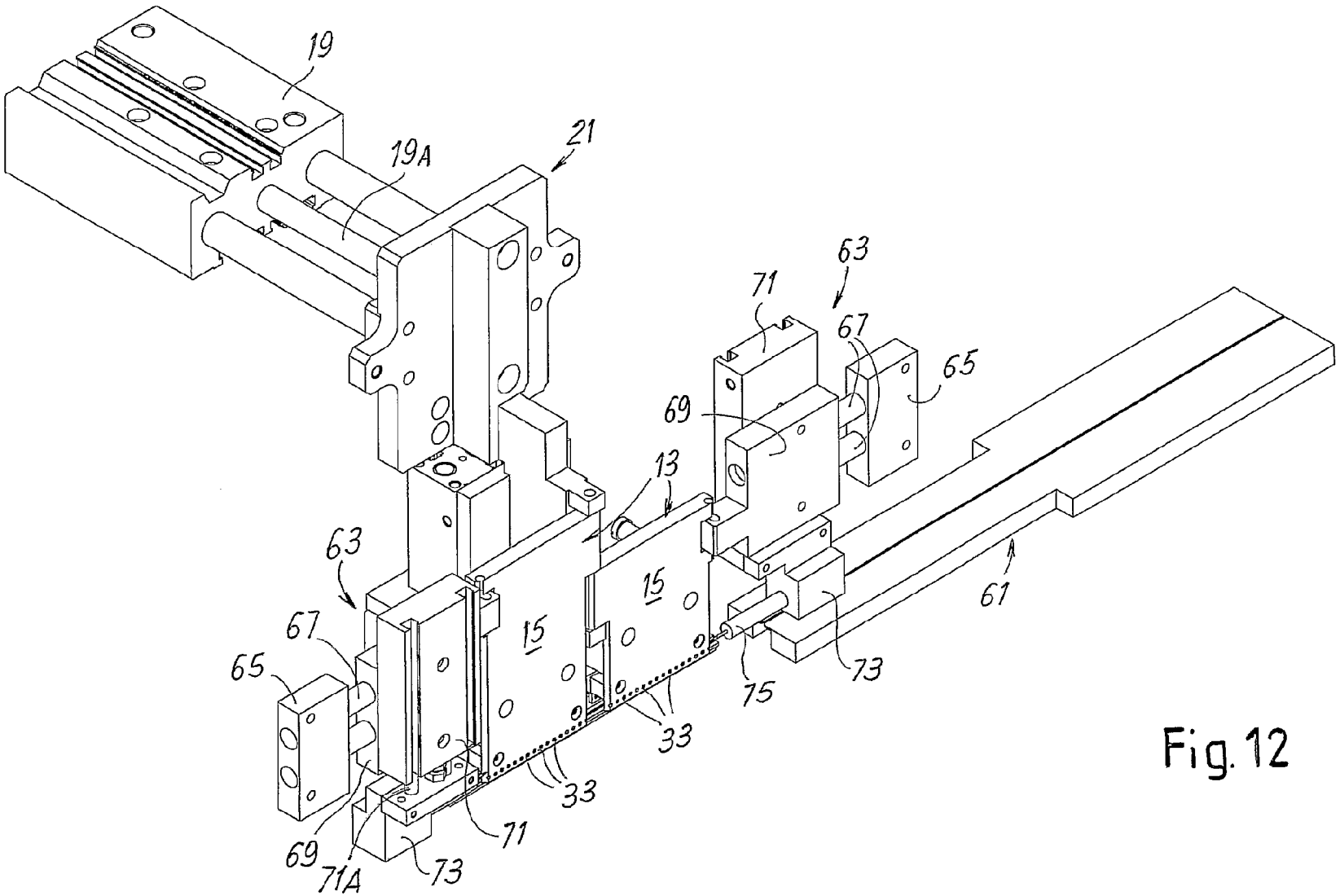
FIGS. 12 and 13 show an axonometric view and a front view of half of the elements to engage the article in a flattened position.

An extractor 47, stressed in the position shown in FIGS. 9 to 11 by compression springs 49 (FIG. 10), is mounted on each bracket 35. Each extractor 47 has holes 51 corresponding in position and number with the needles 17 supported by the respective bracket 35. In this way the needles 17 can penetrate and travel through the respective extractor 47 to penetrate the holes 33 when the bracket 35 is thrust by the springs 41 against the supporting plate 15. This closing movement of the brackets 35 with respect to the plates 15 also causes compression of the springs 49 when the extractor 47 comes into contact with the portion 15B of the respective plate 15.

Immediately above the extractors 47, stops 55 are integral with the portions 15B of the plates 15; these stops are provided, as will be explained hereunder, to align the edge borders or portions of the toe of the article in a straight line before it is inserted in the guide 61 of the sewing machine.

The head 11 is completed by two secondary units 63, which support secondary elements to engage the ends of the flattened toe of the article. Each unit 63 is supported by a support 65 integral with a supporting structure, not shown. Guides 67, along which a slide 69 supporting a piston-cylinder actuator 71 runs, are connected to the support 65. As can be seen in particular in FIGS. 12, 13 and 14, each slide 69 is hinged to a corresponding plate 15 of one of the engaging elements 13. In this way the piston-cylinder actuators 19 which control modification of the configuration of the engaging elements 13 also cause a sliding movement of the slides 69 according to the double arrow f69 (FIGS. 13 and 14) along the guides 67 to follow the oscillating and translational movement of the plates 15.

The piston rod 71A of each piston-cylinder actuator 71 is connected to a block 73 which supports a needle 75 forming a secondary element to engage the edge of the toe of the article when it has been taken to the flattened position by closing of the engaging elements 13, as will be better explained hereunder.

The movement of radial extraction and axial translation of the tabs 9 with respect to the tubular member 3 to allow extraction through the slits 7 in the cylindrical wall 5 and axial removal beyond the final end of the tubular member 3 is obtained with the mechanism shown in detail in FIGS. 15 to 18. The tabs 9 are each equipped with a pair of slots 9A inclined with respect to the rectilinear edge 9B of the respective tab parallel to the axis A of the tubular member 3. Besides the two inclined slots 9A, each tab has a slot 9C with substantially radial extension.

Engaging in the radial slots 9C are pins 81, integral with a block 83 connected to a rod 85 of a piston cylinder actuator, not shown. The translational movement of the rod 85 according to the double arrow f85 parallel to the axis A of the tubular member 3 causes axial sliding of the group of tabs 9, which can in this way be extracted from the upper final end of the tubular member 3 through slits produced in a front closing cover 3A (FIG. 16) of the tubular member 3.

The block 83 has four through holes, extending through which are four corresponding bars or columns 87 connected to a ring 89 and sliding in holes produced in said block 83. Above the block 83 the columns 87 are connected to sectors 89 equipped with pins, which are inserted into the inclined slots 9A. A translational movement of the bars or columns 87 according to the arrow f87 parallel to the axis A of the tubular member 3 consequently causes a movement of radial extraction of the tabs 9 due to the inclination of the slots 9A, in which the pins integral with the sectors 89 engage. Both the radial extraction movement and the axial extraction movement of the tabs 9 with respect to the tubular member 3 are obtained by operating the rod 85 and the bars or columns 87 separately.

Having described the mechanical structure of the device according to the invention, the operation thereof will now be described with specific reference to FIGS. 20 to 28.

Figure 20:
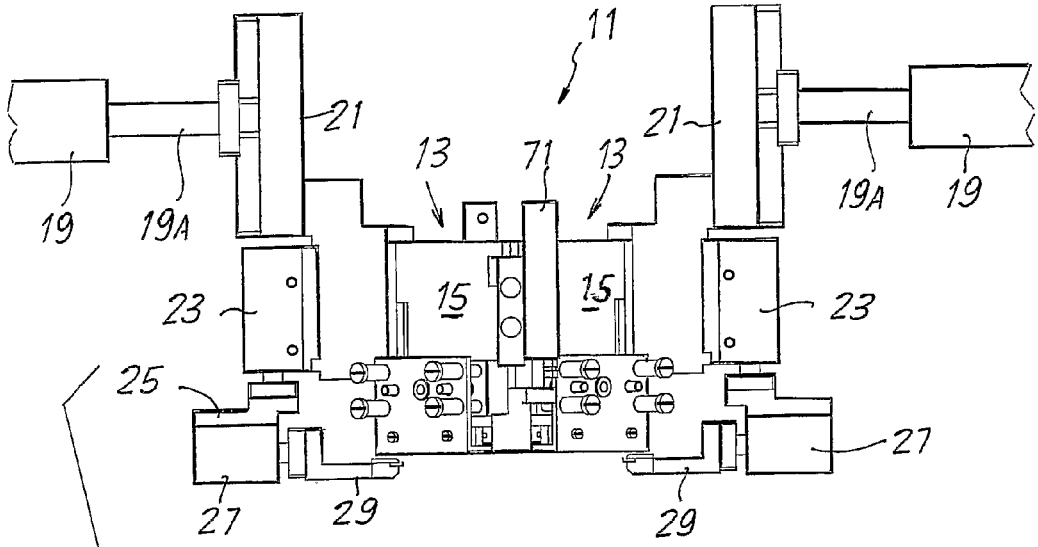
FIG. 20 shows a side view of the device in an initial step of the operating cycle.
Figure 20:
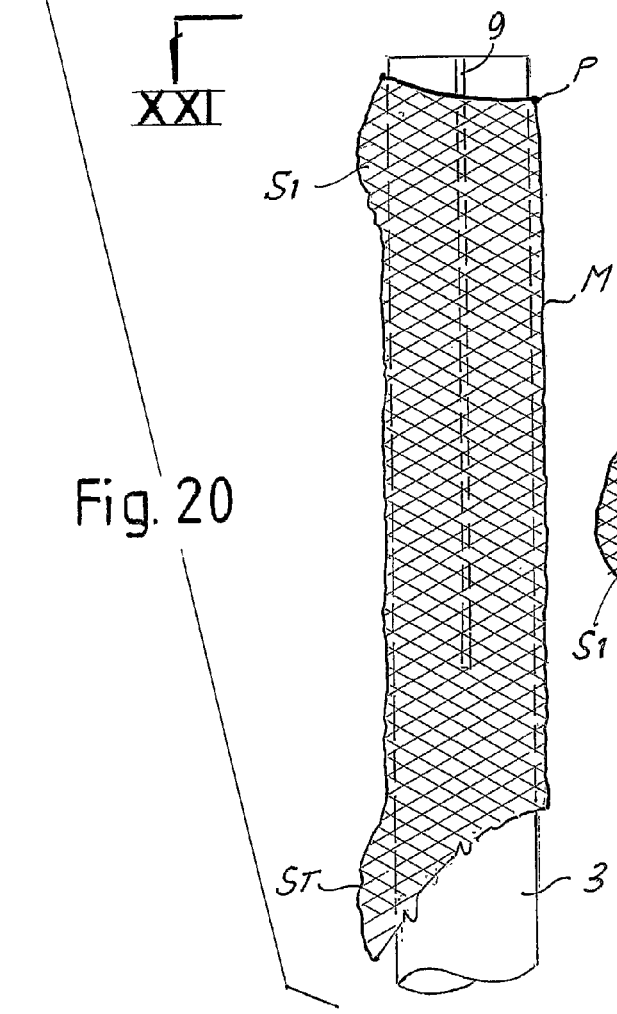
Figure 21:
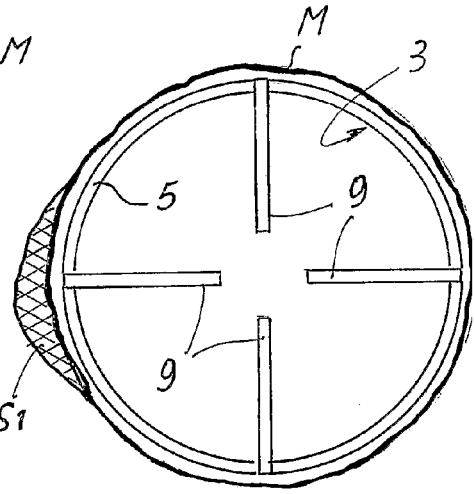
FIG. 21 shows a plan view according to XXI-XXI in FIG. 20.

An article M (typically a sock) to be handled using the device is loaded onto the outside of the tubular member 3, as shown in FIG. 20. In this position the tabs 9 are retracted inside the tubular member 3 and the toe P of the article M is under the upper end of the tubular member 3, in a position which is not necessarily aligned with respect to the upper circular edge of the tubular member 3, as this alignment can be obtained in the subsequent handling steps, as will be explained hereunder. The article M typically has a toe pocket S1 and a heel pocket ST, which are positioned manually or automatically in a specific angular position with respect to the tubular member 3 using known techniques.

The head 11 is standing by above the tubular member 3 with the engaging elements 13 arranged in the open position thereof, i.e. according to a polygonal extension and in particular (as four elements 13 with the same extension are provided) in a square position in the plane (FIG. 3).

Figure 22:
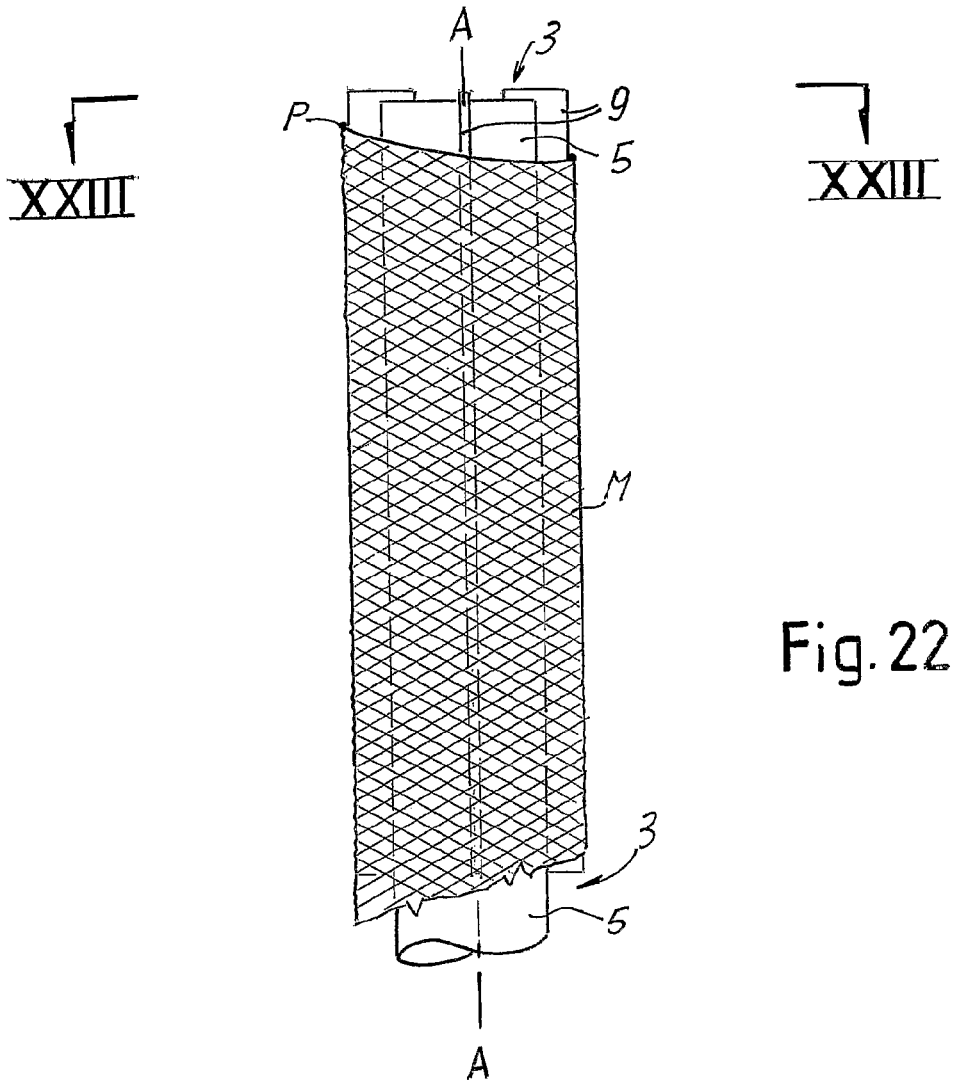
FIG. 22 shows a side view of the tubular member alone in the subsequent operating step to the one shown in FIG. 20.
Figure 23:
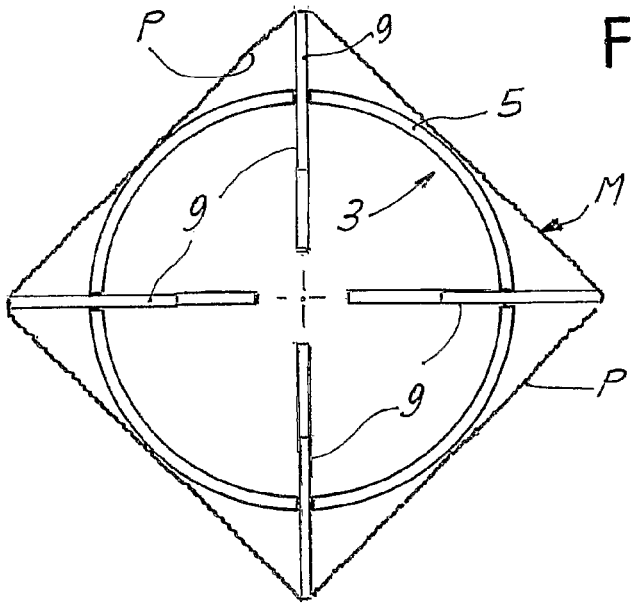
FIG. 23 shows a plan view according to XXIII-XXIII in FIG. 22.
Figure 24:
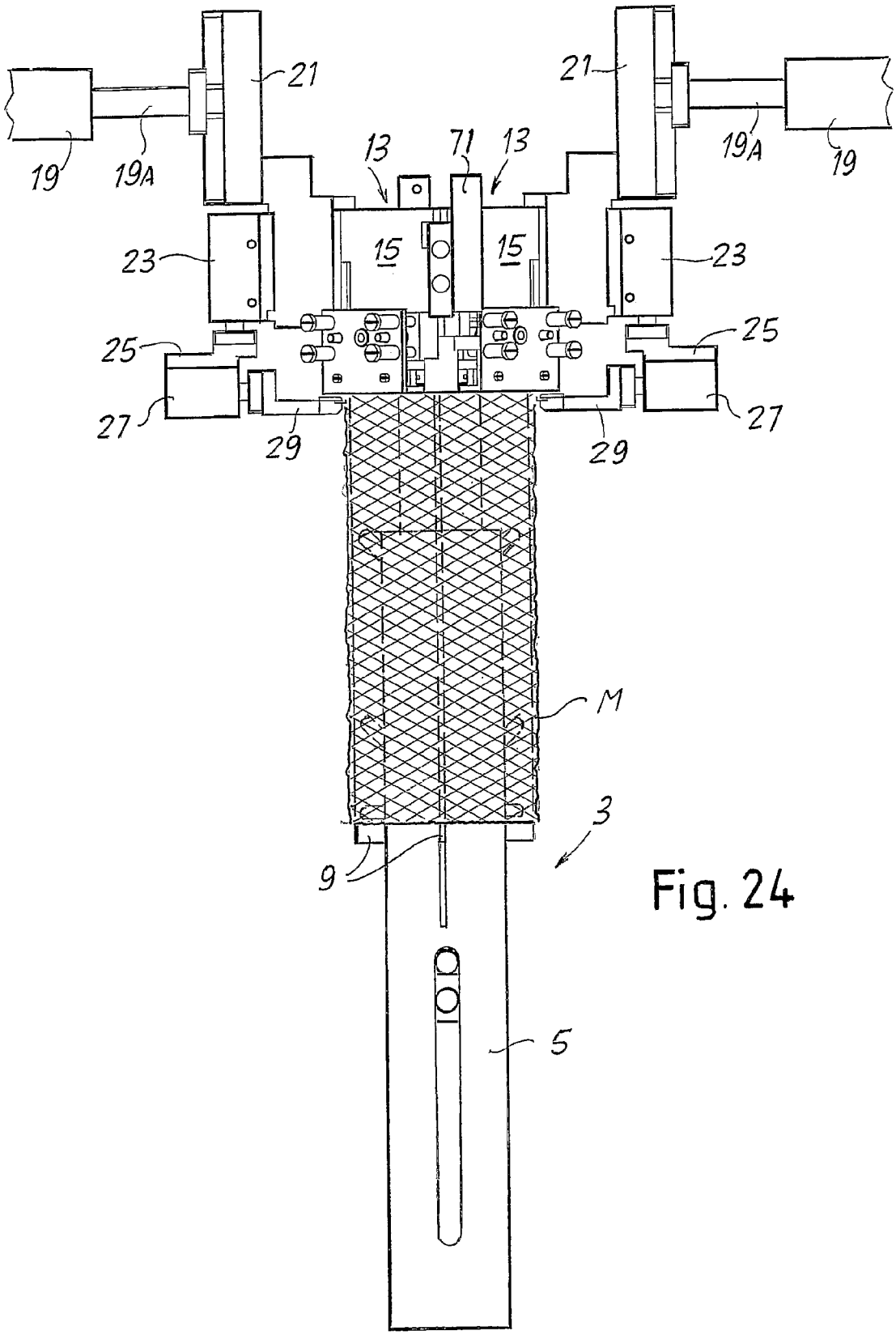
FIG. 24 shows a side view of the device in the subsequent operating step to the one in FIG. 22.

In the subsequent operating step, by means of the mechanism described with reference to FIGS. 15 to 18 the tabs 9 are extracted radially from the cylindrical wall 5 of the tubular member 3, to take the position shown in FIGS. 22 and 23. As a consequence of this extending movement of the tabs 9, the article M inserted over the outside of the wall 5 of the tubular member 3 is spread out and takes the configuration shown in particular in the plan view in FIG. 23: the edge P defining the toe to be closed of the article M is substantially arranged according to a square, with sides of a length approximately equal to the length of the horizontal side (in the drawing) of the plates 15 of the engaging elements 13 and corresponding to the distance between the longitudinal edges 9B of two consecutive tabs 9.

Figure 25:
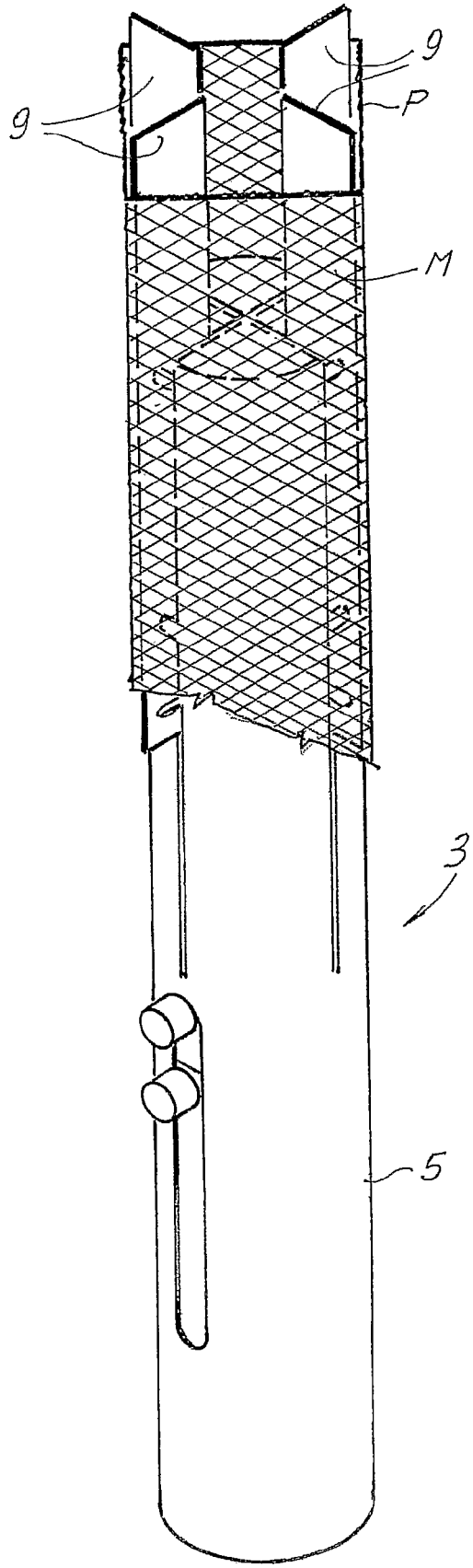
FIG. 25 shows an axonometric view of the tubular member with the tabs extracted and lifted and the article loaded on them corresponding to the position in FIG. 24.

In the subsequent step the tabs 9 are moved upwards parallel to the axis A of the tubular member 3 drawing with them the textile article M, which is consequently partly slipped off from the tubular member 3. FIG. 25 shows an axonometric view of the position taken by the tabs 9 and by the article M with the toe P thereof with respect to the tubular member 3 after this double movement of radial and axial extraction of the tabs 9. Lifting of the tabs 9 is sufficient to take the edge of the toe P of the article in contact with the stops 55 supported by the four plates 15 of the engaging elements 13. The position in which the four edge borders of the article M in the configuration taken in FIG. 25 is in fact such that these borders are inserted between the thinner portions 15B of the four plates 15 and the respective four rows of needles 17 supported by the brackets 35 of the respective elements 13. For this purpose the brackets 35 have been taken to the open position by extension of the respective four piston-cylinder actuators 39. The four extractors 47 associated with the four series of needles 17 of the four engaging elements 13 are also distanced with respect to the thinner portions 15B of the respective plates 15, leaving sufficient space for insertion of the edge of the toe P until it comes into contact with the stops 55. The lifting stroke of the tabs 9 is sufficient to cause the entire edge of the toe P of the article M to come into contact with the stops 55 of the four plates 15, so that the edge is arranged on a plane orthogonal to the axis A of the tubular member 3 even if it was initially arranged in an unaligned fashion.

Having reached this position, the actuators 39 retract to allow the brackets 35, under the thrust of the compression springs 41, to move towards the plates 15 with consequent insertion of the needles 17 in the fabric of the toe. Each series of needles 17 supported by one of the four brackets 35 is inserted in the corresponding border of the toe of the article M held in a rectilinear position by two adjacent tabs 9. With this closing movement the extractor 47 comes in contact with the thinner portion 15B of the respective plate 15 pressing against the fabric of the article M. Once the brackets 35 have been closed by the thrust of the compression springs 41, the tabs 9 are withdrawn from the article and fully retracted inside the tubular member 3.

Figure 3A:
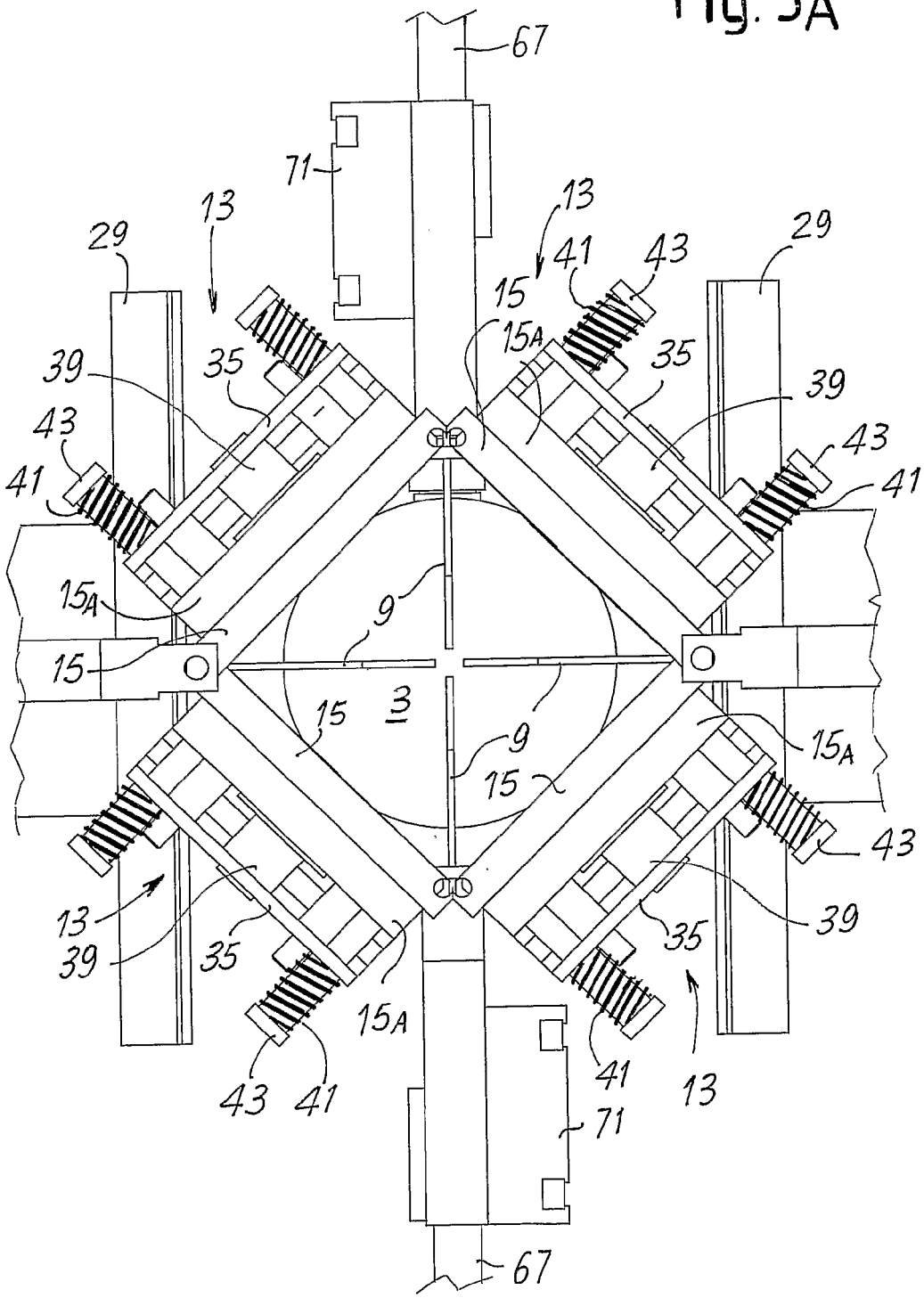
FIG. 3A shows an enlargement of the central area in FIG. 3.
Figure 6:
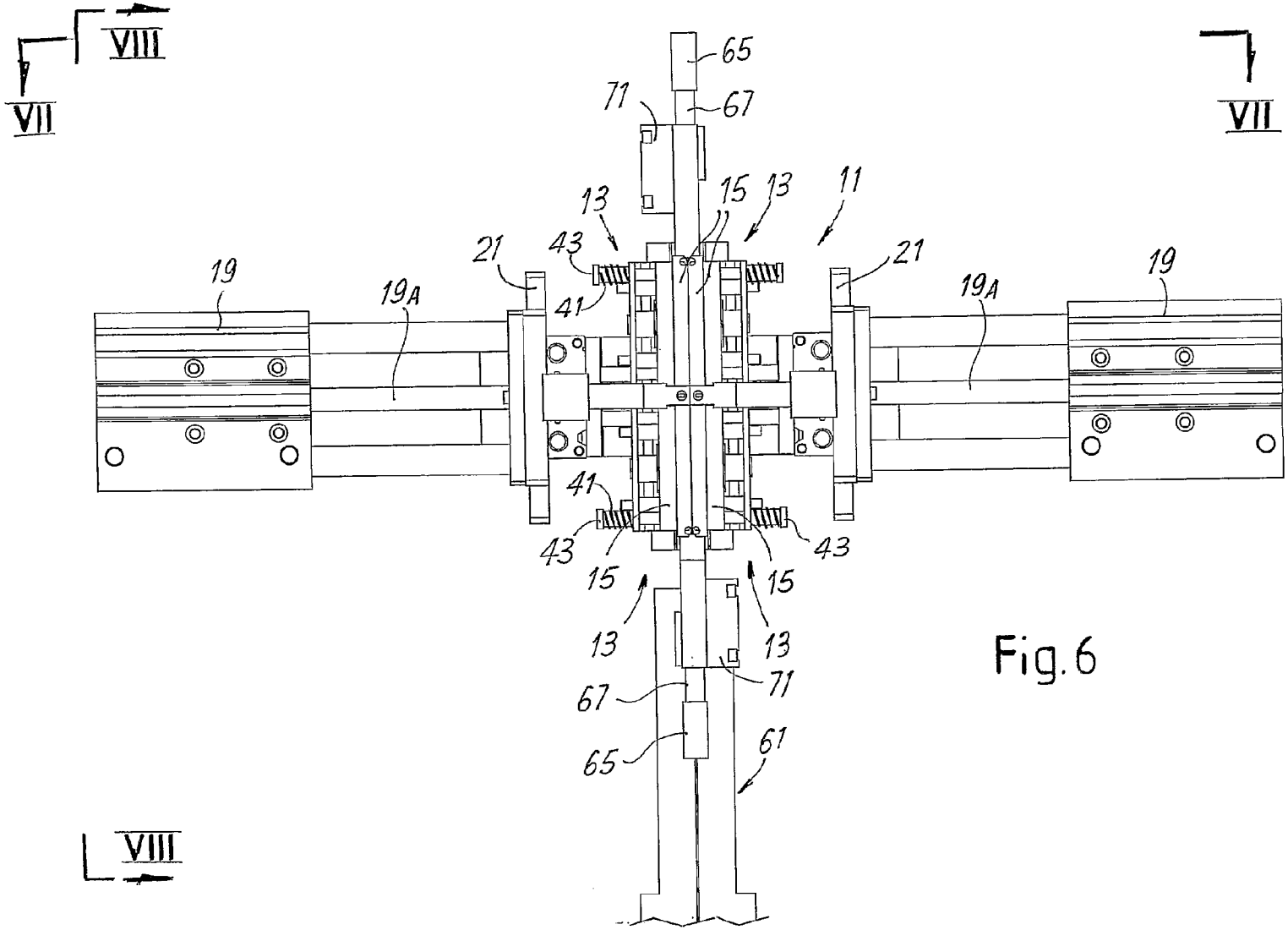
FIG. 6 shows a plan view of the device in the configuration in FIG. 5.
Figure 6A:
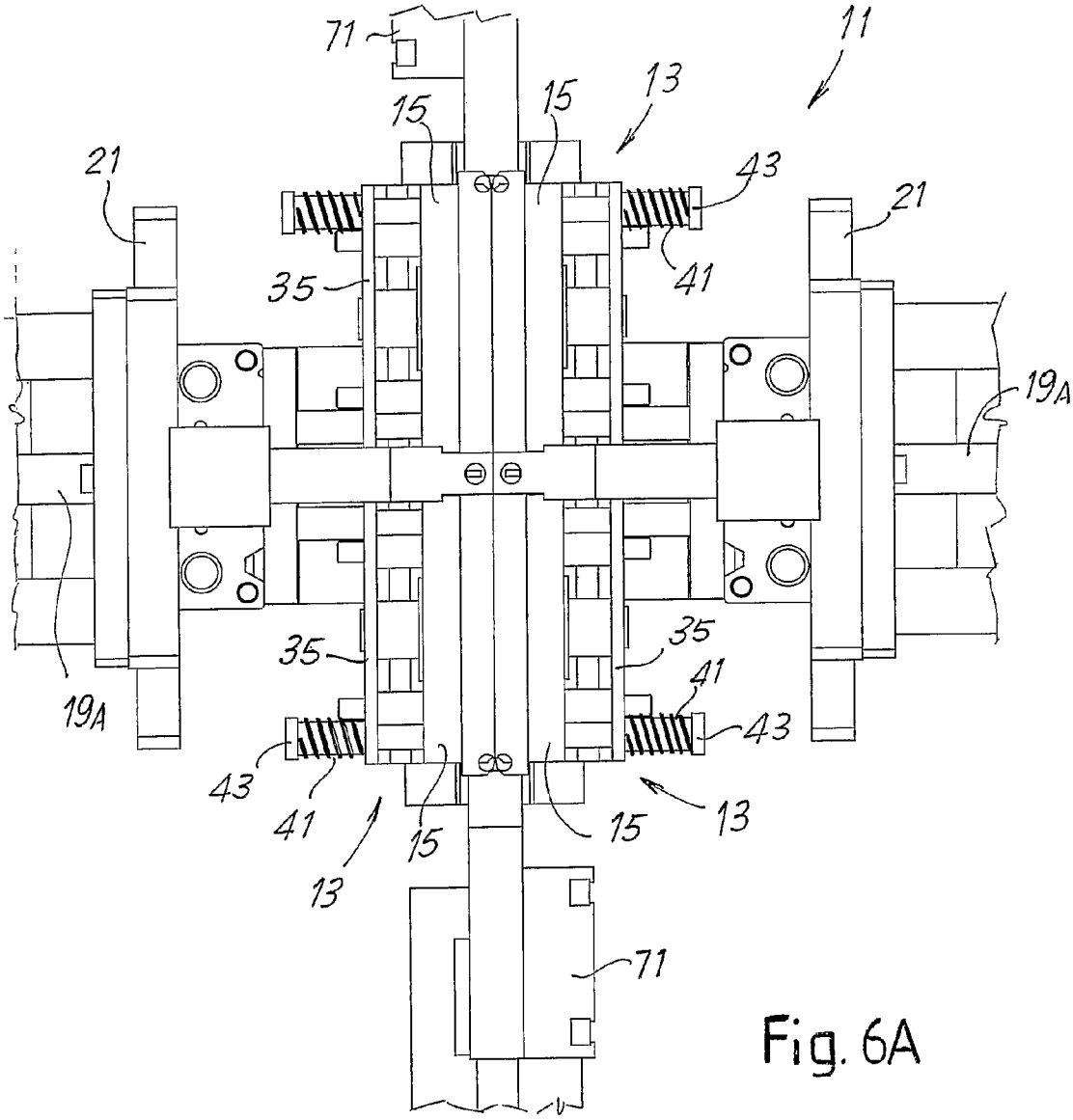
FIG. 6A shows an enlargement of the central part in FIG. 6.
Figure 7:
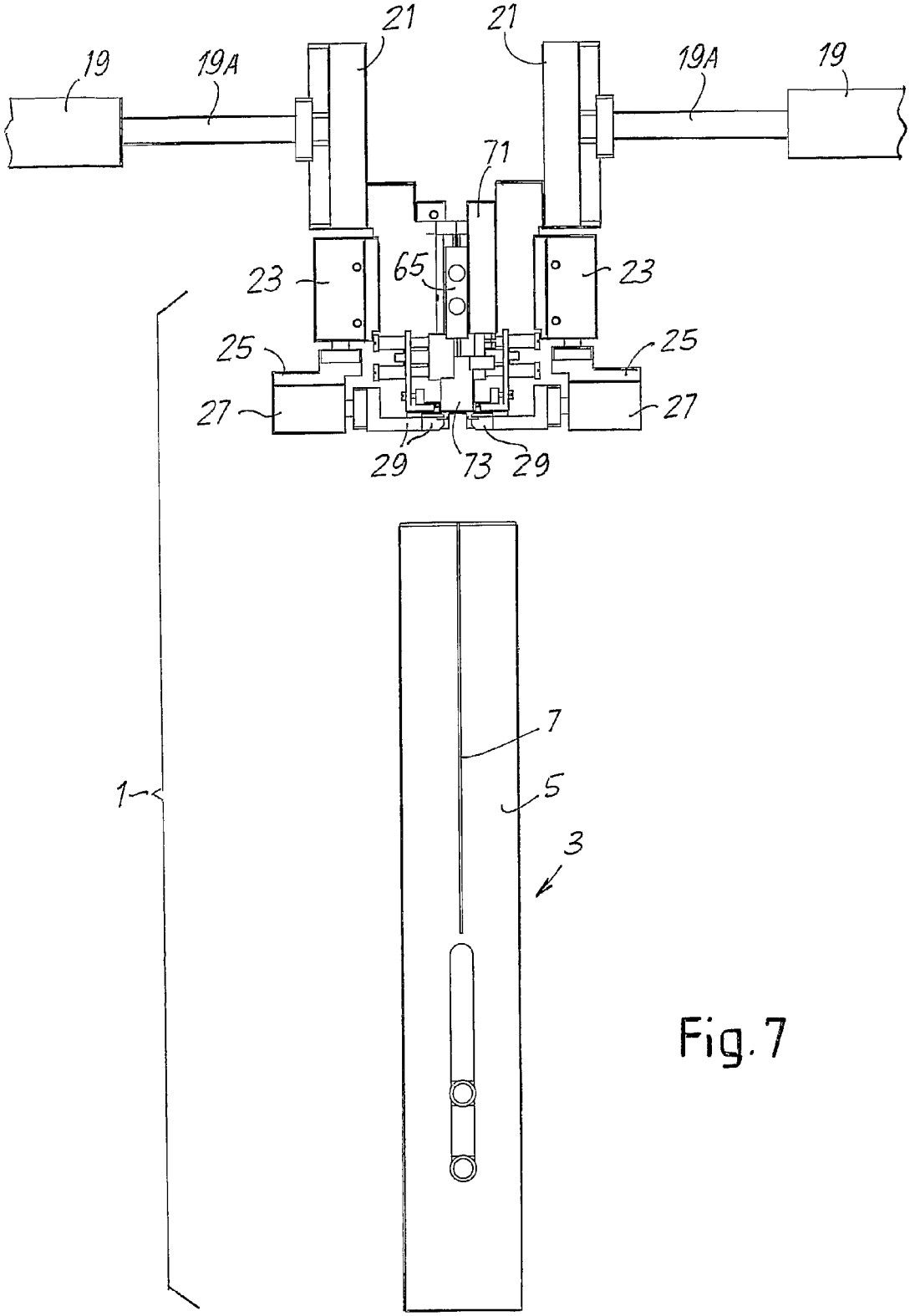
FIGS. 7 and 8 show side views according to VII-VII and VIII-VIII in FIG. 6.
Figure 7A:
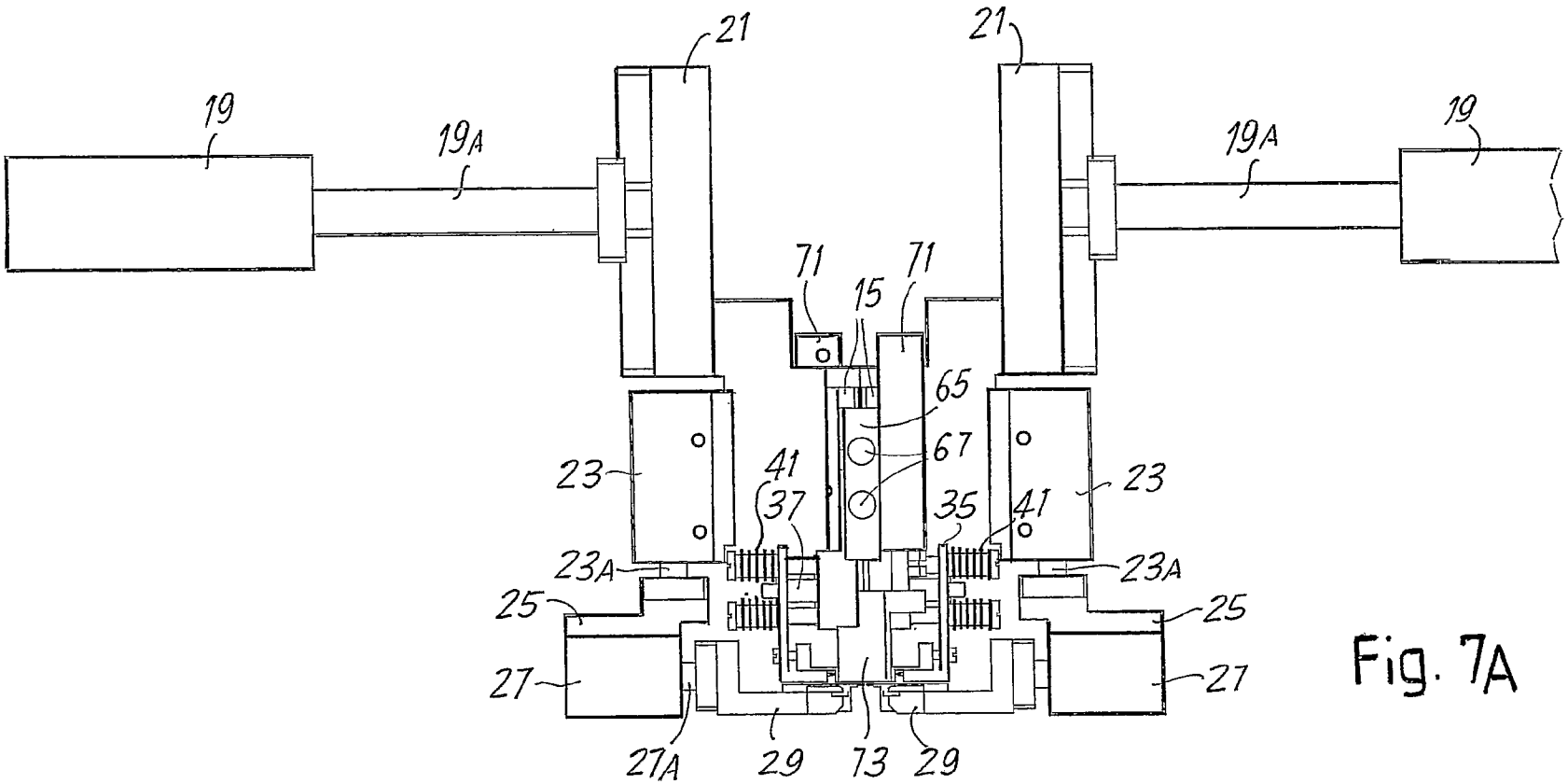
FIGS. 7A and 8A show enlargements of the head of the device in the positions in FIGS. 7 and 8 respectively.
Figure 8:
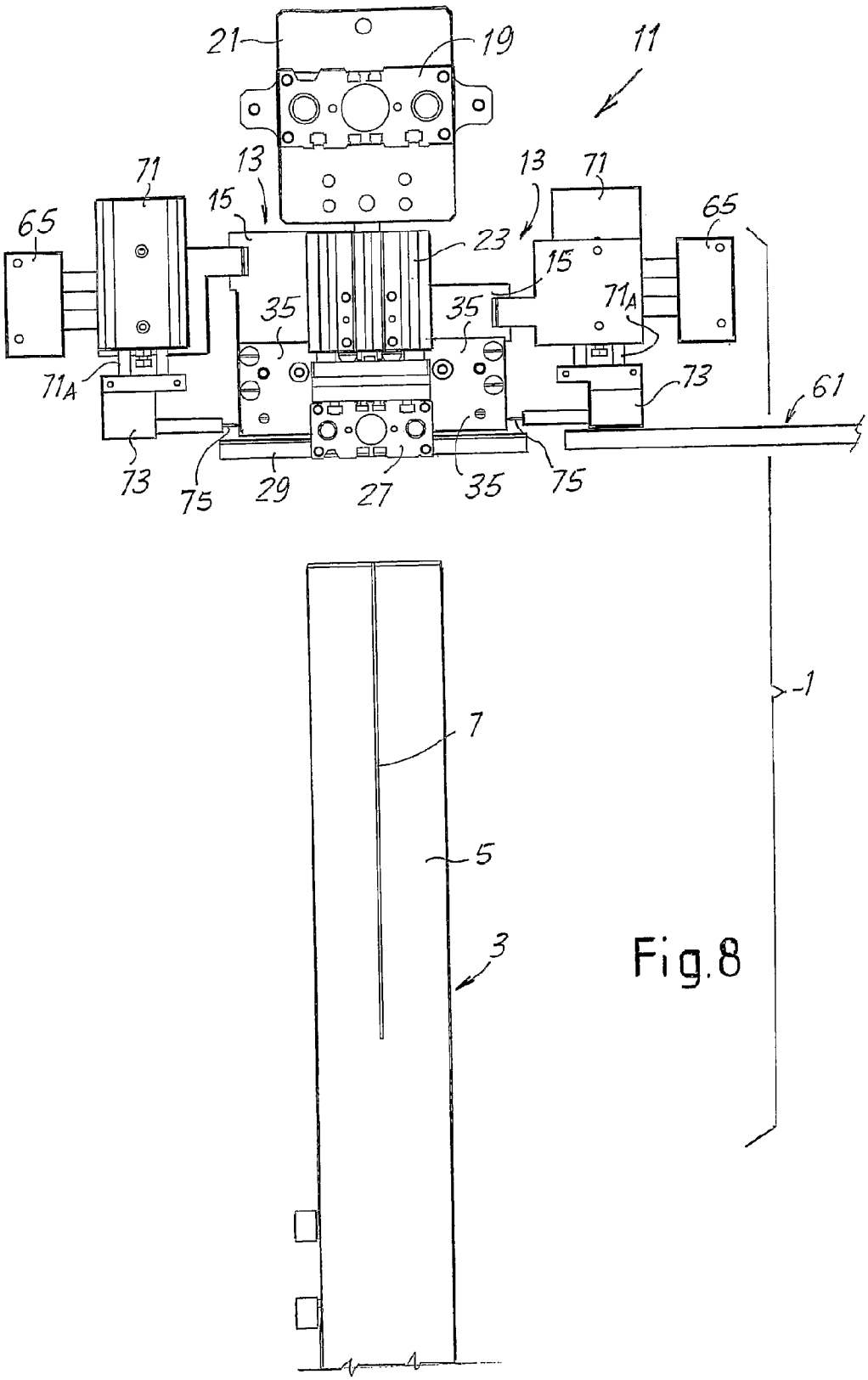
Figure 8A:
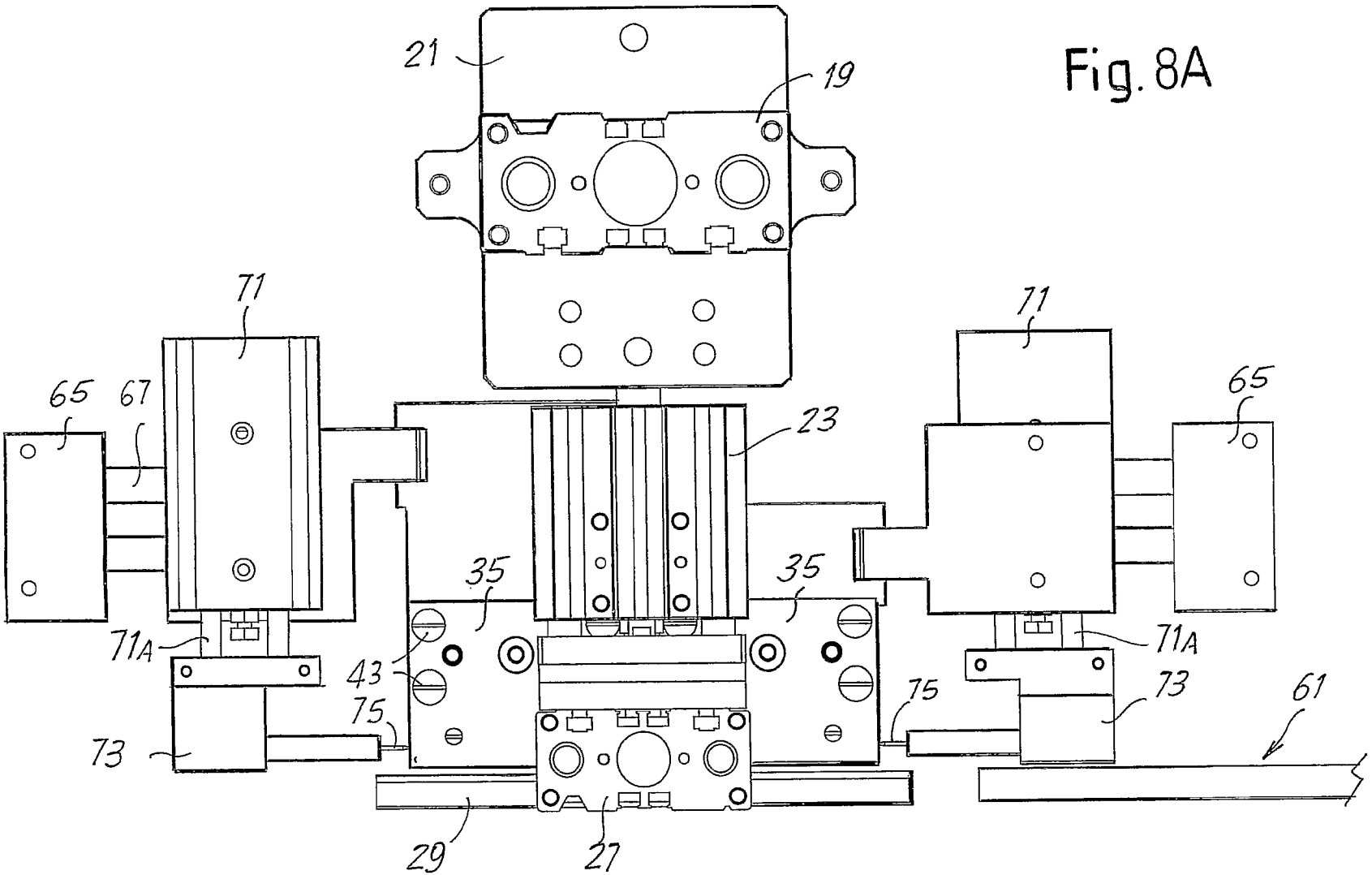
Figure 26:
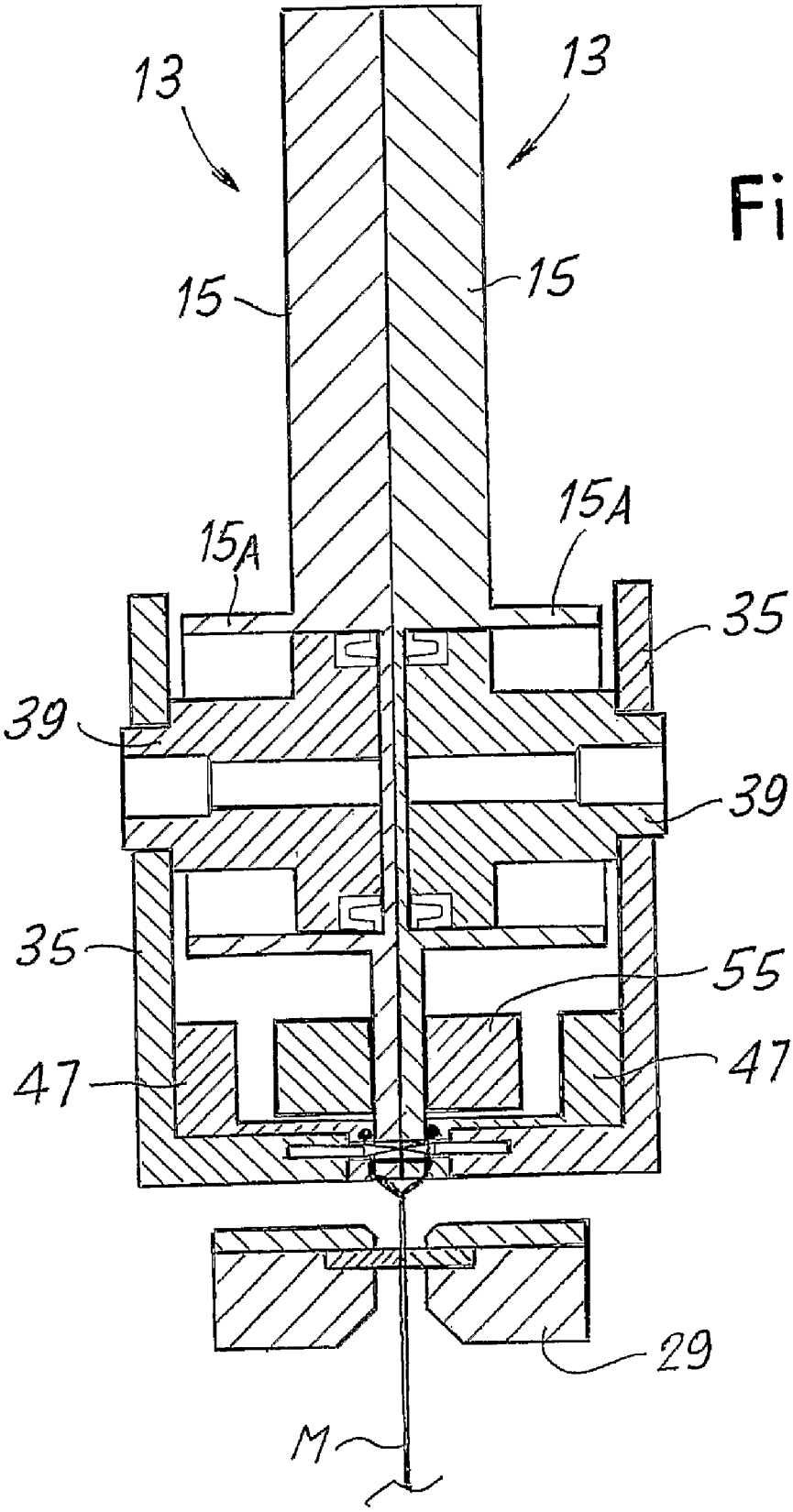
FIGS. 26, 27 and 28 show cross sections of the elements to engage the article in three different operating positions with the article engaged with said elements.

In the subsequent step the piston-cylinder actuators 19 extend to cause the engaging elements 13 to pass from the square configuration (shown in the plan view in FIGS. 3 and 3A) to the rectilinear configuration shown in the plan view in FIGS. 6 and 6A. The position taken by the engaging elements 13 and by the member associated therewith, as well as by the fabric of the article M in this step, is shown in FIG. 26.

Figure 13:
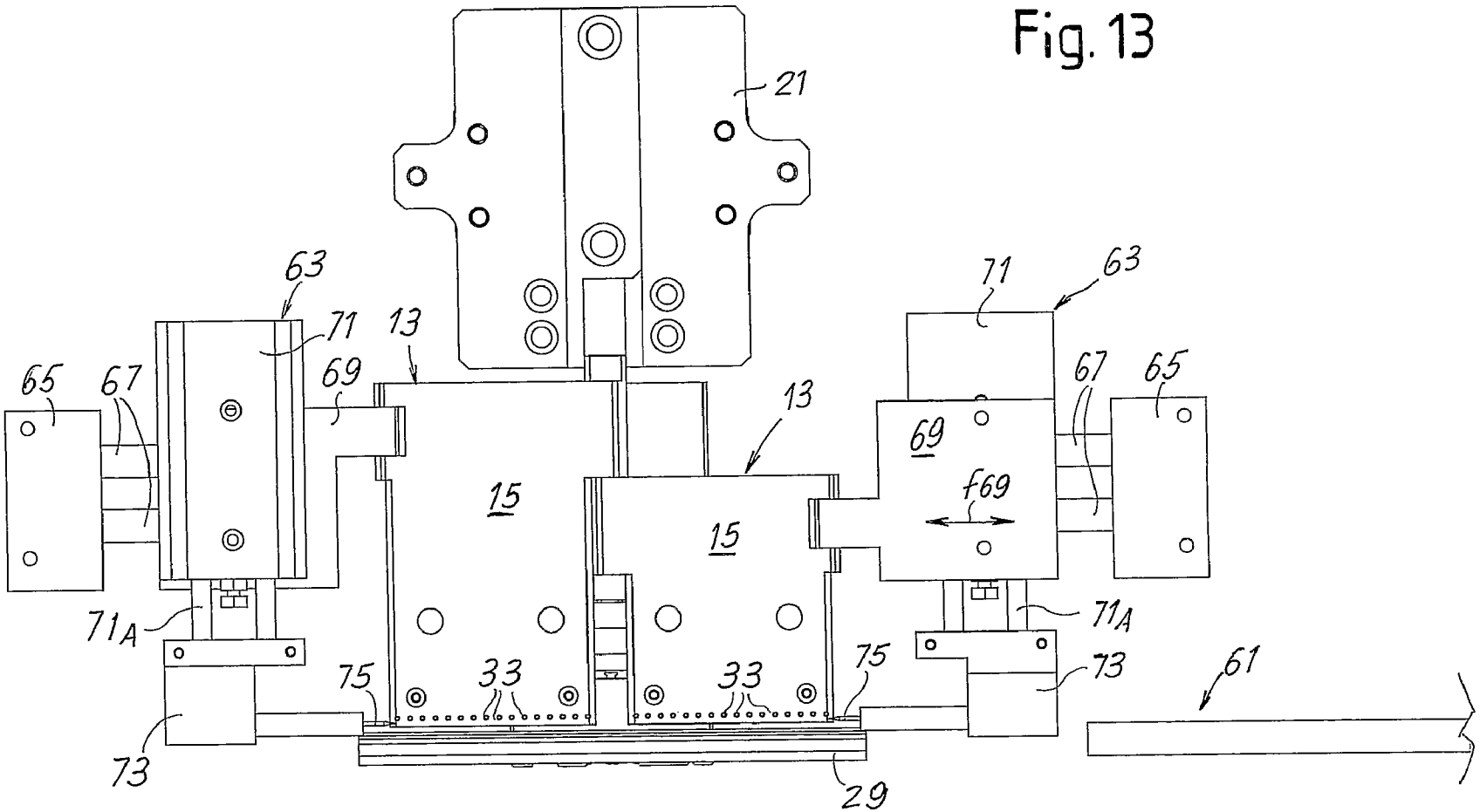
Figure 13A:
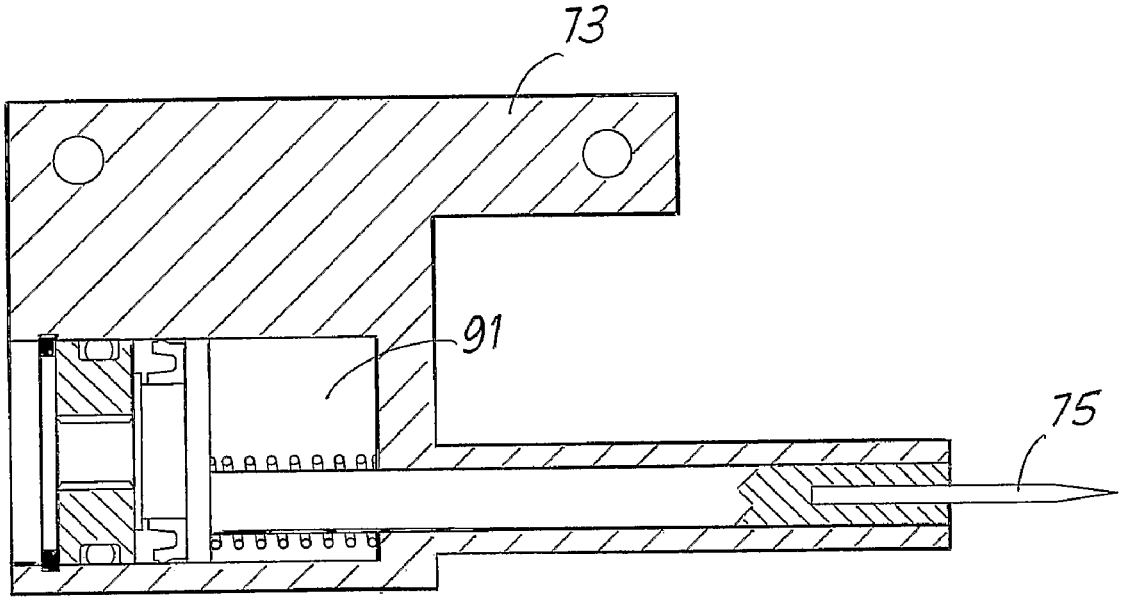
FIG. 13A shows a sectional enlargement of a detail in FIG. 13.
Figure 14:
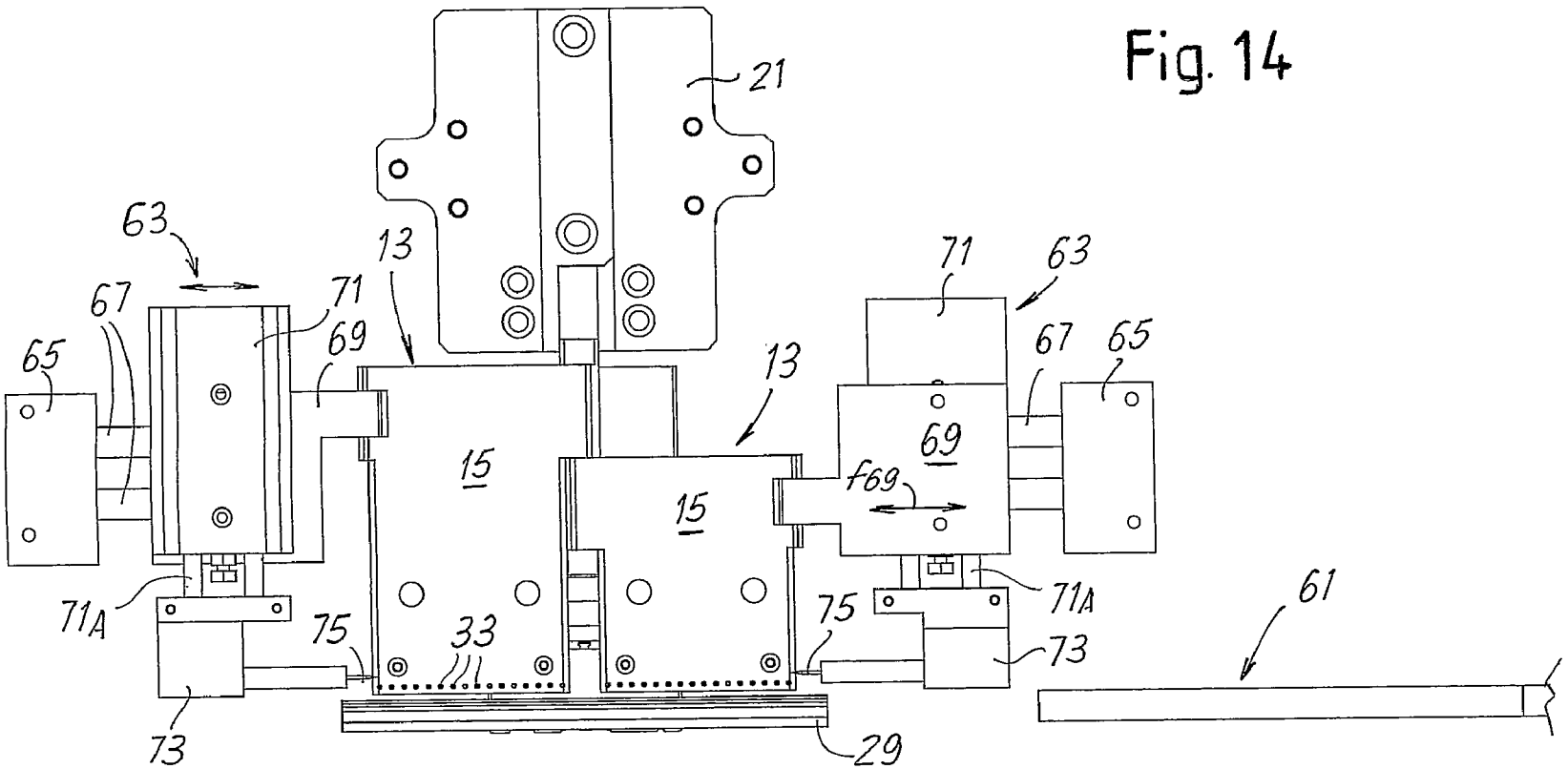
FIG. 14 shows a view analogous to the one in FIG. 13 in a slightly modified configuration of the mechanical members.
Figure 16:
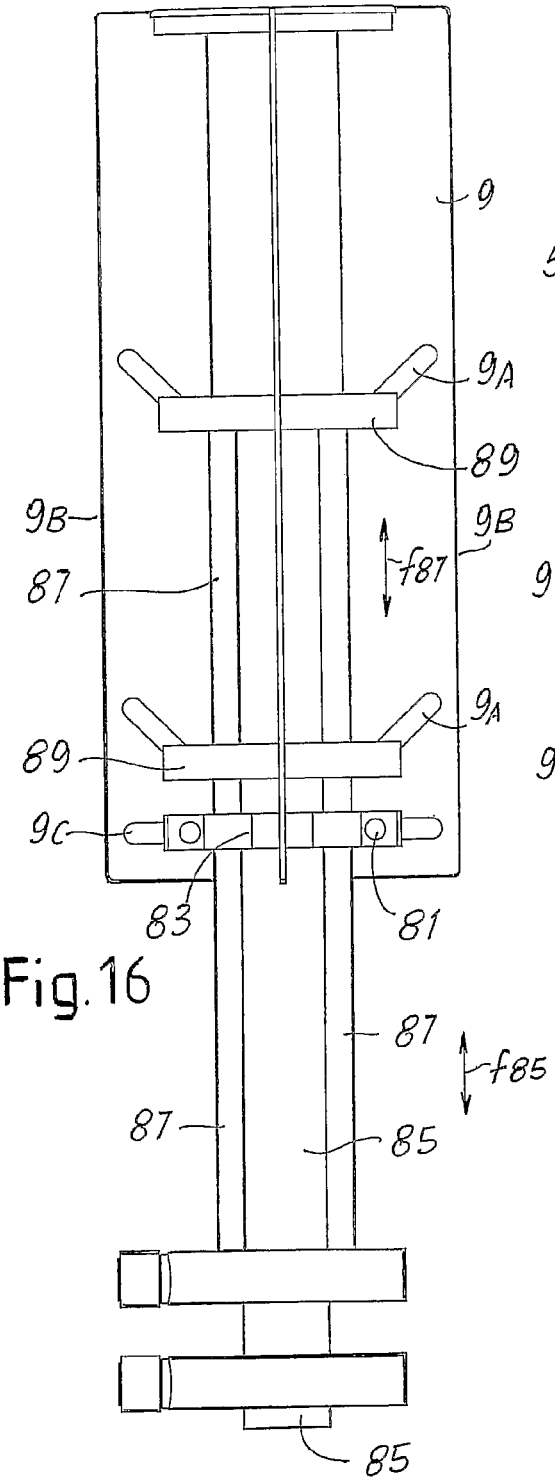
FIG. 16 shows a side view of the elements inside the tubular member, to control the radial and axial extraction movements of the tabs, in the retracted position.
Figure 15:
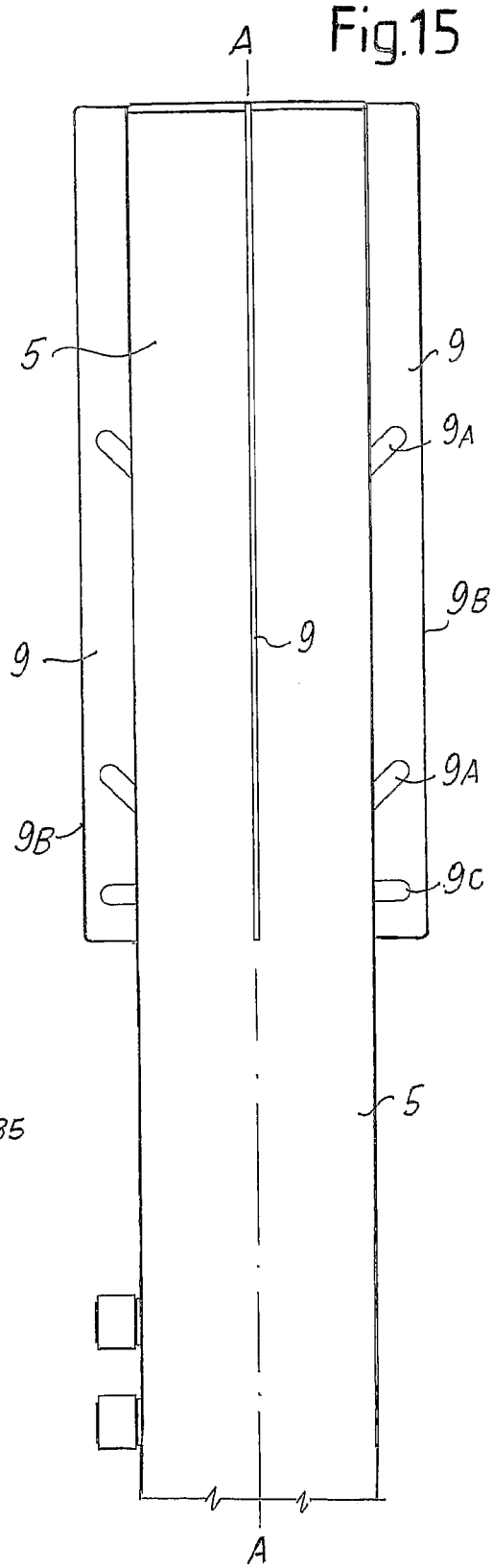
FIG. 15 shows a side view of the tubular member and of the extractable tabs in a radially extracted position.
Figure 19A:
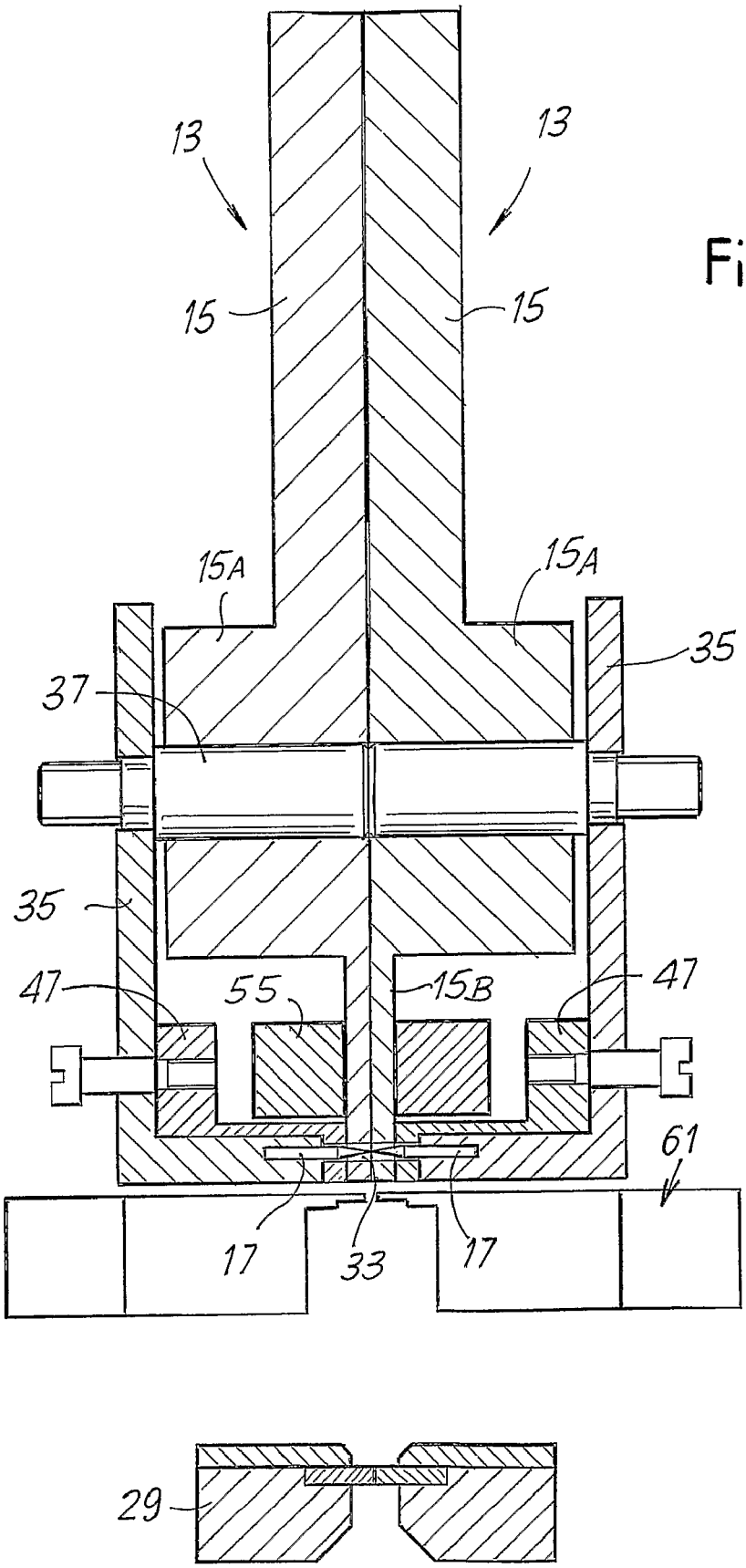
FIGS. 19A, 19B and 19C show cross sections on different planes of the elements to engage the article, analogous to those in FIGS. 9, 10 and 11 but with the members of which they are composed in a different position.
Figure 19B:
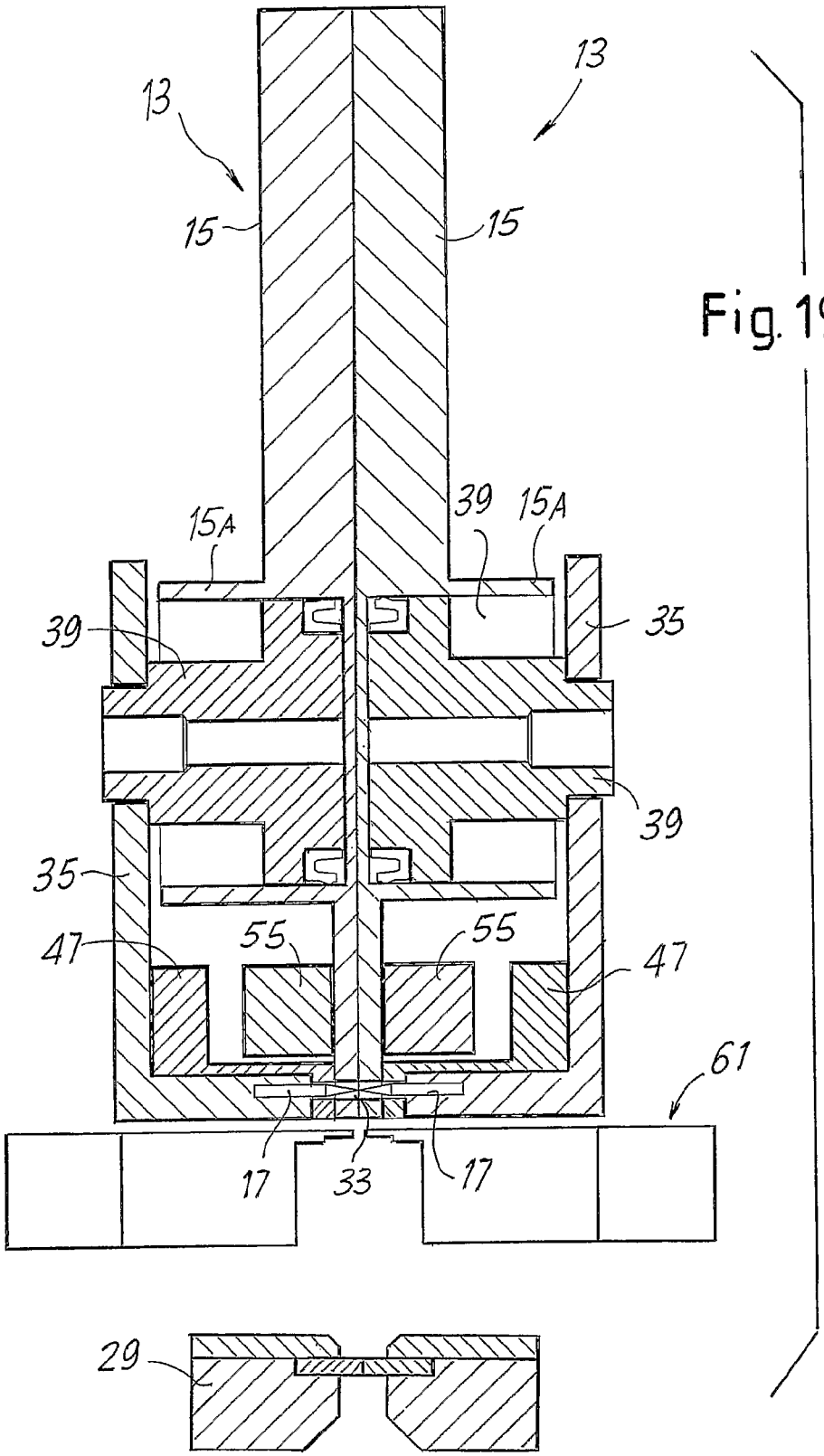
Figure 19C:
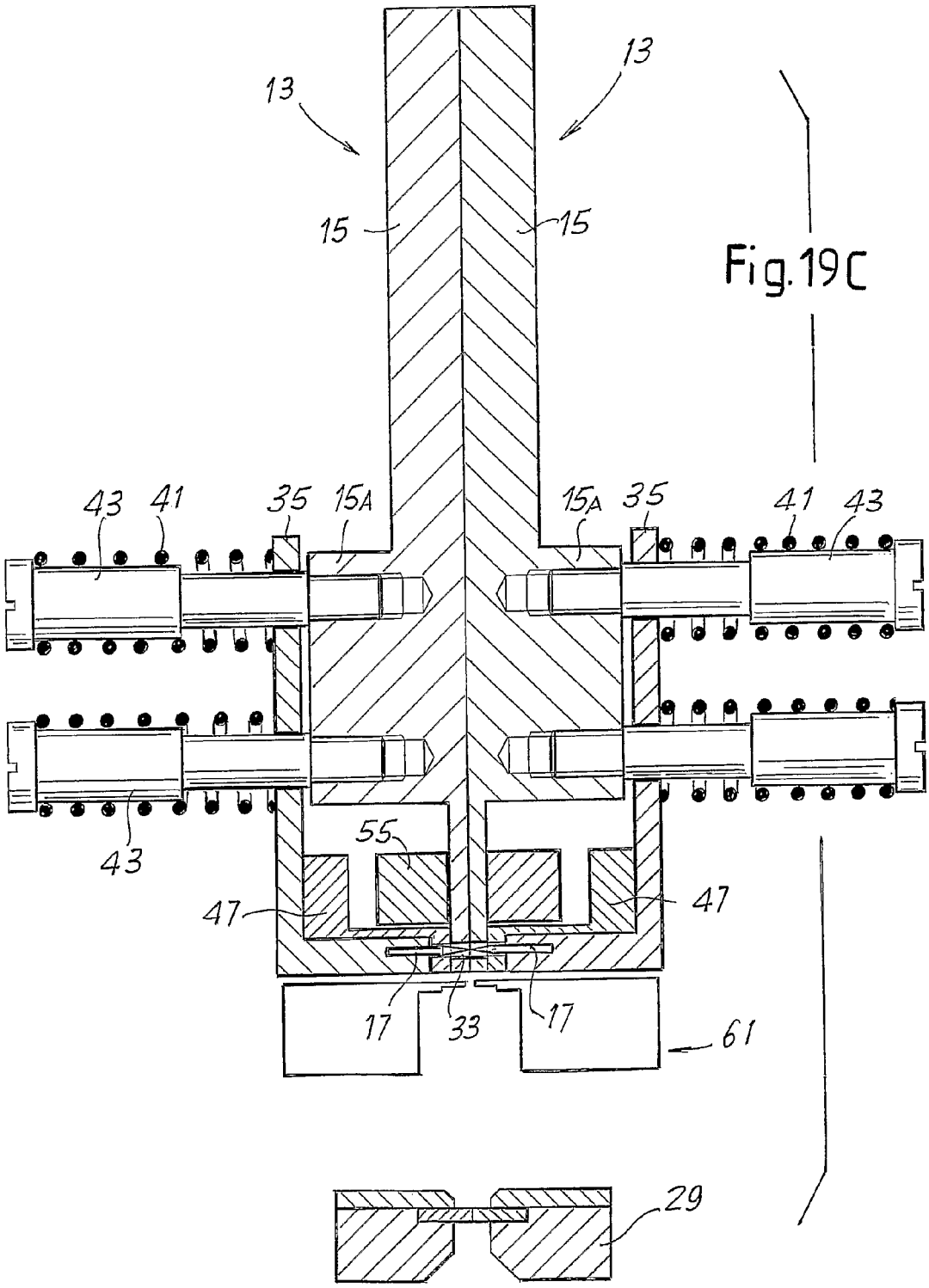

The bars 29 have been closed to clamp the fabric of the article M immediately below the area engaged by the four series of needles 17 supported by the four engaging elements 13. Closing in the flattened configuration of the engaging elements 13 has also caused the secondary needles 75 to penetrate the two end points of the toe of the article which has been folded by moving two opposed pairs of plates 15 reciprocally towards each other. The secondary needles 75 also have a movement parallel to their longitudinal axis, to facilitate insertion in and extraction from the knitted fabric forming the article. This movement is obtained with respective piston-cylinder actuators 91 (see the detail in FIG. 13A) housed in the corresponding blocks 73.

These needles 75 can be lifted by the piston cylinder actuators 71 once they are engaged in the fabric of the article, to pull the fabric upwards, with respect to the bars 29, in the end points of the folded and flattened edge of the toe.

Figure 27:
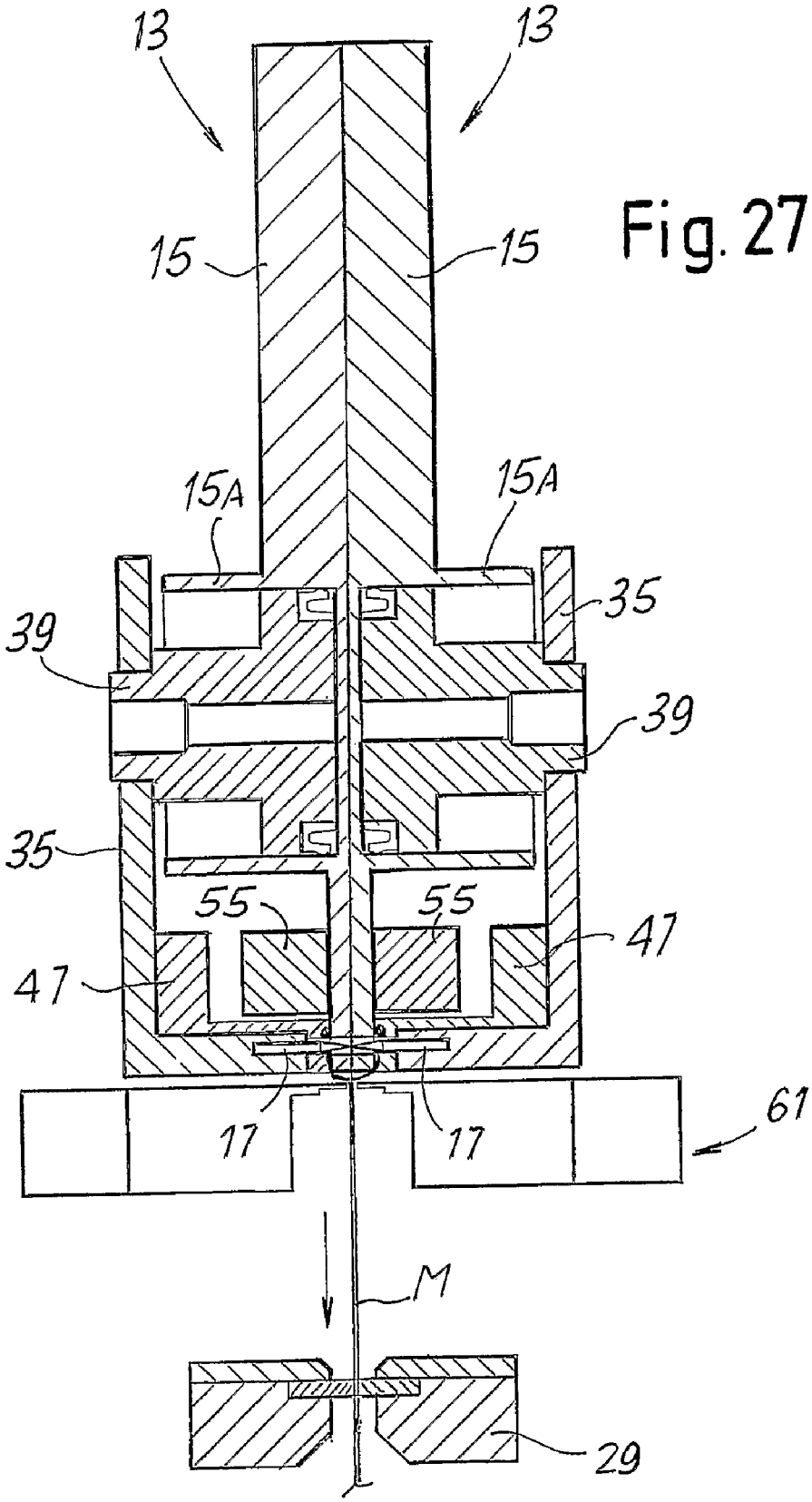
Figure 28:
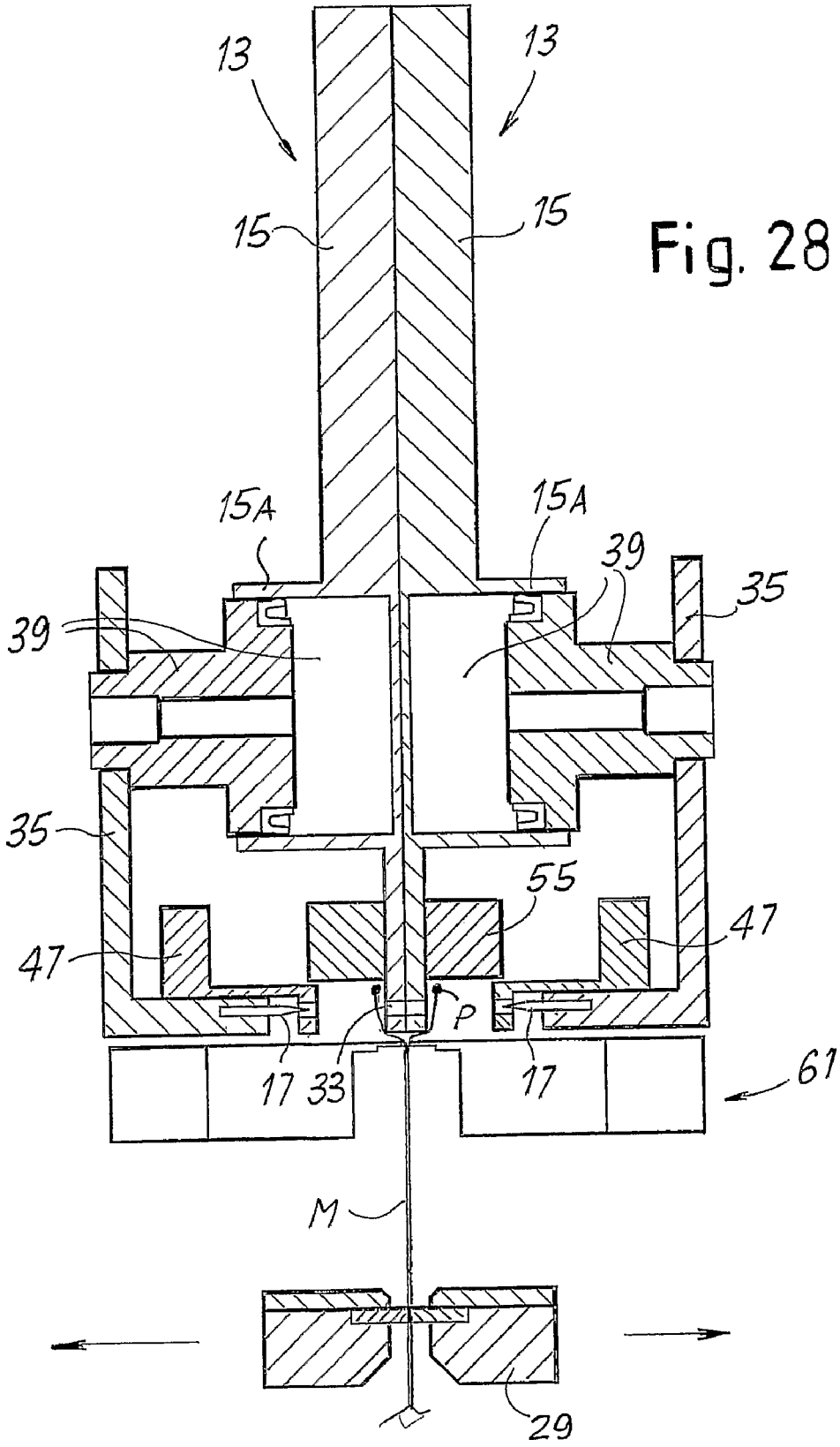

In the subsequent step shown in FIG. 27 the bars 29 are moved away from the engaging elements 13 by the actuators 23 to stretch the portion of textile article between the needles 17 and said bars 29; this portion of stretched fabric can at this point be inserted in the guide 61 which can be provided with a translational movement under the group of engaging elements 13, between them and the bars 29. Alternatively, the head 11 can move sideways in a direction parallel to the alignments of needles 17, towards the fixed guide 61 of the sewing machine.

At this point the article can be released by extending the piston-cylinder actuators 39 and consequently withdrawing the needles 17 from the fabric of the article, said withdrawal being facilitated by the action of the extractors 47. The secondary needles 75 are also withdrawn by the respective actuators 91. The article is completely released by opening of the bars 29 by means of the actuators 27. Removal of the article from the head 11 takes place with a relative withdrawing movement between the head 11 and the guide or guillotine 61. Preferably the movement is performed by the latter. In this way the edge of the toe is removed from the area of the plates 15. Subsequently, the guide 61 is made to move parallel to the longitudinal extension thereof to remove the article M from the operating area of the device. Removal of the article from the tabs 9 and/or from the tubular member 3 can take place with the aid of jaws or other equivalent means, known and not shown.

Opening of the engaging elements 13 by the actuators 19 returns said elements to the spread out configuration to receive the subsequent article.

Movement of the article along the guide or guillotine 61 to the needle of the sewing machine takes place in a known way.

It is understood that the drawing merely shows an example provided purely as a practical example of the finding, which may vary in forms and arrangements without however departing from the scope of the concept on which the finding is based. Any reference numerals in the appended claims are provided to facilitate reading of said claims with reference to the description and to the drawing and do not limit the scope of represented by the claims.

The invention claimed is:

1. A device for handling tubular knitted articles with an open toe to be sewn, the device comprising:

a loading member onto which the tubular knitted article is loaded; and a pick-up member to engage the open toe of the article, wherein said pick-up member has a plurality of engaging elements to engage the toe of the article, each of said engagement elements being arranged about an axis of said loading member, said plurality of engaging elements being movable from a first position to a second position, said plurality of engaging element having a variable geometry, wherein said plurality of engaging elements are arranged in a circular or polygonal configuration in said first position and said plurality of engaging elements are arranged in a substantially rectilinear flattened configuration in said second position.

2. Device as claimed in claim 1, wherein said engaging elements are divided into a first series of elements and a second series of elements, in said flattened configuration the engaging elements of the two series taking a position in which they are adjacent to and opposite each other, with the toe of the article arranged between them in a flattened and substantially rectilinear configuration, the edge of the toe being divided into two edge portions aligned and adjacent with each other.

3. Device as claimed in claim 2, wherein the engaging elements are designed and arranged so that the distance between the ends of the toe in the flattened and substantially rectilinear configuration is greater than the diameter of the circumference according to which the engaging elements are arranged, or of the circumference inside which is inscribed the polygon according to which the elements to engage the toe are arranged.

4. Device as claimed in claim 3, wherein said pick-up member includes at least one actuator to take the engaging elements alternately to a flattened configuration and to an annular or polygonal configuration surrounding the axis of the loading member.

5. Device as claimed in claim 3, wherein said loading member includes a stretching device to stretch the toe of the article, which makes the toe of the article take a polygonal configuration.

6. Device as claimed in claim 2, wherein said pick-up member includes at least one actuator to take the engaging elements alternately to a flattened configuration and to an annular or polygonal configuration surrounding the axis of the loading member.

7. Device as claimed in claim 2, wherein said loading member includes a stretching device to stretch the toe of the article, which makes the toe of the article take a polygonal configuration.

8. Device as claimed in claim 1, wherein said pick-up member includes at least one actuator to take the engaging elements alternately to a flattened configuration and to an annular or polygonal configuration surrounding the axis of the loading member.

9. Device as claimed in claim 8, wherein said loading member includes a stretching device to stretch the toe of the article, which makes the toe of the article take a polygonal configuration.

10. Device as claimed in claim 1, wherein said loading member includes a stretching device to stretch the toe of the article, which makes the toe of the article take a polygonal configuration.

11. Device as claimed in claim 10, wherein said stretcher device includes a plurality of tabs.

12. Device as claimed in claim 11, further comprising four engaging elements to engage the toe of the article, coordinated with four extractable tabs.

13. Device as claimed in claim 10, wherein said stretching device is arranged and designed to make the toe of the article take a quadrangular configuration.

14. Device as claimed in claim 10, wherein said loading member includes a tubular member, associated with which is said stretching device to make the toe of the article take said polygonal configuration, moving it away from the outer surface of the loading member, said loading member being substantially tubular.

15. Device as claimed in claim 14, wherein said stretching device is housed in said tubular loading member and is extractable therefrom to take the toe of the article to a polygonal configuration.

16. Device as claimed in claim 10, wherein said stretching device is movable parallel to the axis of the loading member to transfer the toe of the article from the loading member to the engaging elements.

17. Device as claimed in claim 1, further comprising a removal device to remove the toe of the article from the loading member, the engaging elements being axially staggered with respect to the loading member and the toe of the article being transferred to said engaging elements by said removing device.

18. Device as claimed in claim 1, wherein said pick-up member has a plurality of needles designed and arranged to engage respective portions of the edge of the toe of the article.

19. Device as claimed in claim 18, wherein extractors are associated with said needles to remove the article from the needles.

20. Device as claimed in claim 1, wherein each of said engaging elements includes a plate equipped with a plurality of engaging members to engage the toe of the article.

21. Device as claimed in claim 15, wherein a stretching device to stretch the toe includes a plurality of tabs and wherein when the engaging elements are arranged in the polygonal configuration, each plate is arranged between two consecutive tabs.

22. Device as claimed in claim 20, wherein said engaging members comprise needles.

23. Device as claimed in claim 22, wherein said needles are movable orthogonally to the respective plate.

24. Device as claimed in claim 23, wherein each plate is equipped with a plurality of holes in which said needles penetrate.

25. Device as claimed in claim 15, wherein said plates are hinged to each other about axes substantially parallel to the axis of said loading member.

26. Device as claimed in claim 25, wherein said engaging members of each plate are aligned according to a direction orthogonal to the hinge axes with which the respective plate is connected to the adjacent plates.

27. Device as claimed in claim 1, further comprising stops to align the toe of the article according to a plane substantially orthogonal to the axis of the loading member.

28. Device as claimed in claim 27, wherein each of said engaging members includes a plate equipped with a plurality of engaging elements to engage the toe of the article and each of said plates is equipped with a stop to align the toe of the article.

29. Device as claimed in claim 1, further comprising a stretching member to stretch the article when the toe thereof has been engaged by said engaging elements.

30. Device as claimed in claim 1, further comprising a pair of secondary engaging elements opposite each other and aligned with the direction according to which the engaging elements are arranged when they are in the substantially rectilinear flattened configuration.

31. Device as claimed in claim 30, wherein said secondary engaging elements each have at least one needle.

32. Device as claimed in claim 30, wherein said secondary engaging elements are provided with a movement parallel to the axis of the loading member.

33. Device as claimed in claim 32, wherein said secondary engaging elements are connected to said engaging elements.

34. Device as claimed in claim 1, further comprising a guillotine or guide inside which the toe of the article is inserted in the flattened configuration.

35. Method for handling tubular knitted articles, with an open toe to be sewn, the method comprising the steps of:

arranging the article with the toe in an open configuration;

engaging a first portion of the edge of the toe in a plurality of positions and a second portion of the edge of the toe in a further plurality of positions; and placing the first portion of the edge and the second portion of the edge adjacent to each other to give the toe a substantially rectilinear flattened configuration.

36. Method as claimed in claim 35, wherein said open toe is arranged in a polygonal configuration wherein consecutive portions of the edge of the toe are arranged approximately according to the sides of a polygon, and wherein each side of said polygon is engaged by a respective engaging element, the sides of the polygon being aligned to make the toe take said substantially rectilinear flattened configuration.

37. Method as claimed in claim 36, wherein the toe of said article is arranged on a loading member.

38. Method as claimed in claim 37, wherein the toe of the article is removed from the loading member remaining in a polygonal configuration, and subsequently the sides of the polygon are engaged by the respective engaging elements and aligned to take the substantially rectilinear flattened configuration.

39. Method as claimed in claim 36, wherein the toe of said article is arranged on a loading member, and after having been arranged on the loading member the toe of the article is subsequently stretched moving it away from the outer surface of the loading member taking said polygonal configuration, the loading member having a substantially tubular shape.

40. Method as claimed in claim 36, wherein said polygon is a quadrangle.

41. Method as claimed in claim 36, wherein the toe of said article is arranged on a loading member and said toe takes the polygonal configuration when it is arranged on the loading member.

42. Method as claimed in claim 35, wherein the ends of the toe in said substantially flattened configuration are engaged by secondary engaging elements.

43. Method as claimed in claim 35, wherein the edge of the toe of the article is stretched in a direction parallel to the longitudinal extension of said guide.

44. Method as claimed in claim 35, wherein said article is stretched longitudinally when said toe has taken said substantially flattened configuration.

45. Method as claimed in claim 44, wherein the article is inserted in a guide or guillotine to perform sewing of the toe and wherein the article is inserted in said guide after having been stretched longitudinally.

46. Method as claimed in claim 35, wherein the article is inserted in a guide or guillotine to perform sewing of the toe.

47. Method as claimed in claim 46, wherein said polygon is a quadrangle, and wherein said guide and said engaging elements are reciprocally moved away to completely release the article from the engaging elements.

48. Method as claimed in claim 35, further comprising the steps of:

loading an article onto a loading member and making the toe of the article take a polygonal configuration, wherein consecutive portions of the edge of the toe of the article are arranged according to sides of a polygon;

engaging said edge portions with engaging members;

positioning said engaging members adjacent to each other in a flattened configuration to flatten the toe of the article;

stretching the article longitudinally;

inserting the article in a guide;

releasing the article from the engaging elements and moving the guide and the engaging elements reciprocally away from each other;

moving the article along the guide towards a sewing device.

49. A device for handling tubular knitted articles with an open toe, the device comprising:

a stretching means for arranging the toe of the article such that the toe of the article has a polygonal article configuration, with consecutive portions of the edge of the toe being arranged according to the sides of a polygon, said stretching means being arranged in a polygonal stretching means configuration, said polygonal stretching means configuration corresponding to said polygonal article configuration.

50. Device as claimed in claim 49, wherein said stretching means includes a plurality of engaging elements which engage each of said portions of the edge of the toe of the article.

51. Device as claimed in claim 50, wherein said engaging elements are designed and arranged to alternatively take an open configuration, according to the sides of said polygon, and a flattened position, wherein a first group of said engaging elements are arranged aligned with one another and adjacent to a second group of said engaging elements.

52. Method for handling tubular knitted articles, with an open sewn, the method comprising the steps of:

providing a plurality of engaging elements;

moving said engagement elements into a substantially polygonal configuration such that the article with the toe is arranged in a substantially polygonal configuration, wherein consecutive portions of the edge of the toe are arranged approximately according to the sides of a polygon;

engaging each portion of the edge of the toe by means of at least one of said engaging elements; and moving said engaging elements such that the article with the toe with said substantially polygonal configuration is arranged in a substantially flattened configuration.

53. Method as claimed in claim 52, further comprising the step of aligning the sides of the polygon to make the toe take a substantially rectilinear flattened configuration.

* * * * *